US009694623B2

(12) United States Patent
Bitoh

(10) Patent No.: US 9,694,623 B2
(45) Date of Patent: Jul. 4, 2017

(54) DRAWING APPARATUS AND DRAWING CONTROL METHOD FOR DRAWING APPARATUS

(71) Applicant: CASIO COMPUTER CO., LTD., Shibuya-ku, Tokyo (JP)

(72) Inventor: Hiroyasu Bitoh, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 2 days.

(21) Appl. No.: 14/981,205

(22) Filed: Dec. 28, 2015

(65) Prior Publication Data

US 2016/0185154 A1 Jun. 30, 2016

(30) Foreign Application Priority Data

Dec. 26, 2014 (JP) ..... 2014-263846

(51) Int. Cl.
*B41J 29/393* (2006.01)
*B43L 13/00* (2006.01)
*A45D 29/00* (2006.01)

(52) U.S. Cl.
CPC ..... *B43L 13/00* (2013.01); *A45D 29/00* (2013.01); *A45D 2029/005* (2013.01)

(58) Field of Classification Search
CPC ..... B41J 11/002; B41J 2/01; B41J 2/04505; B41J 3/28; B41J 2/04508; B41J 13/32; B41J 3/4073; B41J 3/543
See application file for complete search history.

(56) References Cited

U.S. PATENT DOCUMENTS 6,286,517 B1 9/2001 Weber et al.

FOREIGN PATENT DOCUMENTS

JP 2003534083 A 11/2003

*Primary Examiner* — Lamson Nguyen
(74) *Attorney, Agent, or Firm* — Holtz, Holtz & Volek PC

(57) ABSTRACT

A drawing apparatus includes a drawing unit, a test-writing portion, and a control unit including a drawing tool identification unit.

At least one drawing tool is loaded in the drawing unit and the drawing tool draws on a drawing target and a drawing medium different from the drawing target. A drawing medium is placed on the test-writing portion. The drawing tool identification unit acquires a test target image from an area on the drawing medium drawn with the drawing tool in the test-writing portion, and identifies a type of the drawing tool loaded in the drawing unit on the basis of the test target image.

15 Claims, 10 Drawing Sheets

DRAWING APPARATUS AND DRAWING CONTROL METHOD FOR DRAWING APPARATUS

CROSS-REFERENCE TO RELATED APPLICATIONS

This application is related to and claims priority to Japanese Patent Application No. 2014-263846, filed Dec. 26, 2014, the entire contents of which are incorporated herein by reference.

BACKGROUND OF THE INVENTION

1. Field of the Invention

The present invention relates to a drawing apparatus and a drawing control method of a drawing apparatus.

2. Description of the Related Art

A nail printing apparatus for printing a desired nail design on a finger nail of a person has conventionally been known. An example of such a nail printing apparatus is disclosed in, for example, JP-T-2003-534083.

With such an apparatus, people can enjoy nail printing easily without going out to a nail salon.

Currently examined nail printing apparatuses include a plotter type drawing apparatus including a drawing tool (pen). In this apparatus, a pen nib is brought into direct contact with a surface of a drawing target and draws a design on the target.

When the plotter type drawing apparatus is employed as the nail printing apparatus, it is possible to use various kinds of ink such as ink including a pigment (coloring material) with a large particle diameter or lame, and sticky ink, which cannot be easily employed in the inkjet type apparatus. The plotter type drawing apparatus can eliminate a user's labor of applying "base coat (white foundation)", "absorbing layer" and "top coat" and can provide the automatic nail printing as beautiful as the nail art offered at the nail salon.

In the case of using the plotter as the nail printing apparatus, some users may use the ink with various colors and types in accordance with the picture and need to have the apparatus loaded with a pen which is appropriate for the picture to draw.

In view of this, it is preferable that the type of pen loaded in the pen holder is detectable on the apparatus side and whether the appropriate type of pen is loaded or not can be checked before the start of drawing.

In the conventional plotters, however, the use of a plurality of kinds of pens is not expected and some plotters do not have the function of detecting the type of pen loaded in the pen holder. In such cases, the inappropriate pen is not detected, so that the nail printing may be failed.

Conventional methods of detecting the type of pen include, for example, a method of attaching a type identifying barcode to the pen and reading the barcode with a sensor, and a method of printing a type identifying mark or the like on the pen and reading the mark with a sensor.

Such methods, however, would increase the cost of pens because the pens need to have the barcode or the mark printed thereon. The cost of the plotter would also increase because the plotter needs to have the sensor.

In addition, in order to draw a minute picture using the plotter as the nail printing apparatus, it is necessary to control the position of the pen on the nail as precisely as possible.

In this perspective, in order to align the position of the pen accurately by a mechanical way, the pen attachment mechanism or the pen shape needs to have high accuracy, which would increase the cost of the apparatus and the pen. In addition, there are a change in the movement mechanism in the apparatus over time and a variation in the fabrication of pens, which are unavoidable factors.

For these reasons, even if the nail printing apparatus and the pen have high accuracy, the aforementioned factors may cause the displacement of the position of the pen on the nail from the desired position. When, for example, the picture contains different colors, the border between the different colors is deviated a little due to the above factor and the design is ruined. Thus, it is difficult to achieve the precise finishing.

BRIEF SUMMARY OF THE INVENTION

The present invention provides the following advantageous effect of providing a drawing apparatus including a pen, which can accurately detect the type of pen and the position of the pen with a simple structure on the apparatus side and can perform precise nail printing, and moreover providing a drawing control method of a drawing apparatus.

According to an embodiment of the present invention, there is provided a drawing apparatus including: a drawing unit in which at least one drawing tool is loaded, the drawing tool drawing on a drawing target and a drawing medium different from the drawing target; a test-writing portion on which the drawing medium is placed; and a control unit which includes a drawing tool identification unit configured to identify a type of the drawing tool loaded in the drawing unit on the basis of a test target image acquired from an area on the drawing medium drawn with the drawing tool in the test-writing portion.

According to another embodiment of the present invention, there is provided a drawing apparatus including: a drawing unit in which at least one drawing tool, which draws on a drawing target and a drawing medium different from the drawing target, is loaded; a test-writing portion on which the drawing medium is placed; and a control unit, wherein the control unit includes a drawing position correction unit configured to determine whether a drawing position of the drawing tool is displaced from a preset normal drawing position on the basis of a test target image acquired from an area of the drawing medium drawn with the drawing tool in the test-writing portion, and in a case where it has been determined that the drawing position is displaced from the preset normal drawing position, calculate a correction value for correcting the drawing position to the normal drawing position.

According to another embodiment of the present invention, there is provided a drawing control method of a drawing apparatus, wherein the drawing apparatus includes a drawing unit in which at least one drawing tool, which draws on a drawing target and a drawing medium different from the drawing target, is loaded, and a test-writing portion on which the drawing medium is placed, the drawing control method including: a test-writing step of drawing with the drawing tool loaded in the drawing unit on the drawing medium placed on the test-writing portion; an image acquiring step of acquiring a test target image from an area of the drawing medium on which drawing with the drawing tool is carried out; and a identifying step of identifying a type of the drawing tool loaded in the drawing unit on the basis of the test target image.

According to another aspect of the present invention, there is provided a drawing control method of a drawing apparatus, wherein the drawing apparatus includes a drawing unit in which at least one drawing tool, which draws on a drawing target and a drawing medium different from the drawing target, is loaded, and a test-writing portion on which the drawing medium is placed, the drawing control method including: a test-writing step of drawing with the drawing tool loaded in the drawing unit on the drawing medium placed on the test-writing portion; an image acquiring step of acquiring a test target image from an area of the drawing medium on which drawing with the drawing tool is carried out; and a drawing position determining step of determining whether a drawing position of the drawing tool on the drawing medium is displaced from a preset normal drawing position on the basis of the test target image; and a correction value calculating step of calculating a correction value for correcting the drawing position to the normal drawing position in a case where it has been determined that the drawing position is displaced from the preset normal in the drawing position drawing position determining step.

BRIEF DESCRIPTION OF THE SEVERAL VIEWS OF THE DRAWING

FIG. 10A is a top view and FIG. 10B is a side view.

DETAILED DESCRIPTION OF THE INVENTION

Figure 1B:
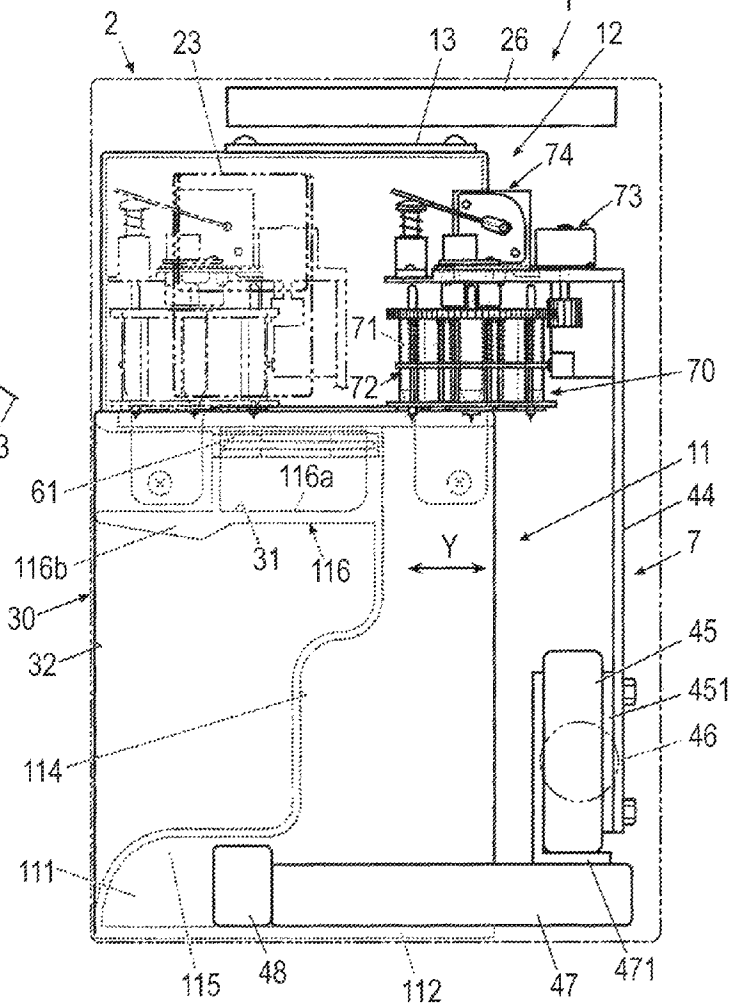
FIG. 1B is a side sectional view illustrating an internal structure of a cross section of a part of the drawing apparatus illustrated in FIG. 1A.

An embodiment of a nail printing apparatus (drawing apparatus) according to the present invention is hereinafter described with reference to the drawings.

The embodiment described below contains various limitations that are technically preferable for carrying out the present invention but these limitations do not restrict the scope of the present invention to the embodiment and the illustrated examples.

In the embodiment below, the nail printing apparatus is intended to a finger nail of a hand and draws a design on the surface of the nail. However, the drawing target of the present invention is not limited to the finger nail of a hand but may be a finger nail of a foot.

Figure 1A:
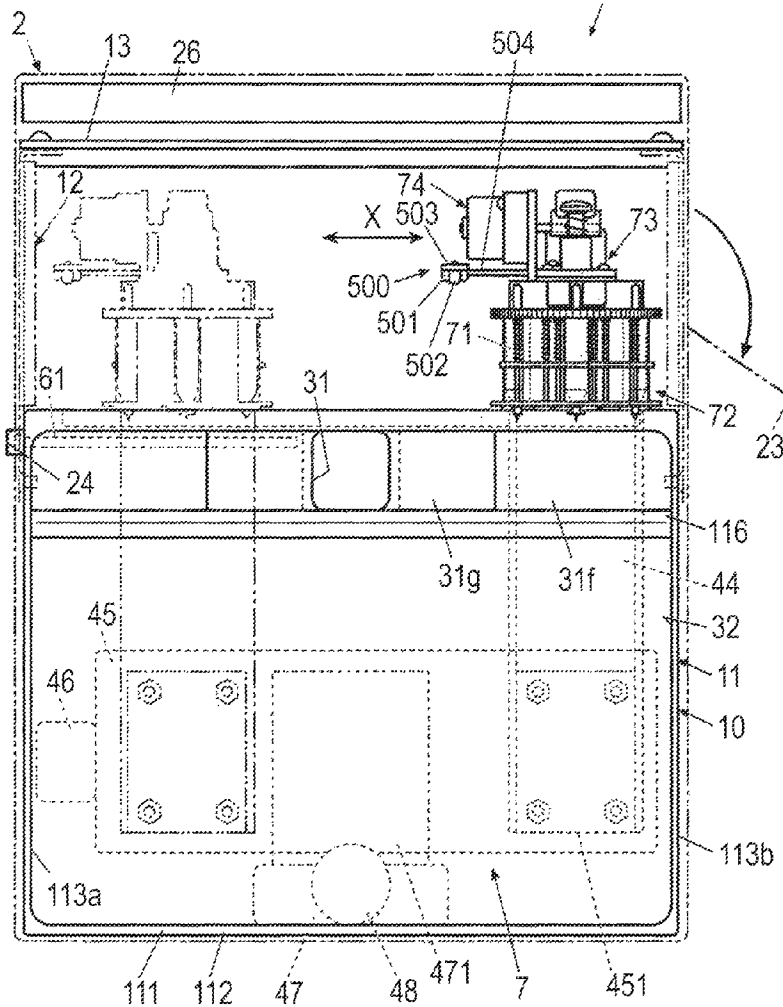
FIG. 1A is a front view of a drawing apparatus according to an embodiment.

FIG. 1A is a diagram illustrating an internal structure of a nail printing apparatus. FIG. 1B is a side sectional view illustrating an internal structure of a cross section of a part of the nail printing apparatus illustrated in FIG. 1A.

As illustrated in FIG. 1A and FIG. 1B, a nail printing apparatus (drawing apparatus) 1 in this embodiment is a plotter type printing apparatus in which a drawing head 70 includes a pen 71 that draws on a nail T of a print finger U1.

The nail printing apparatus 1 includes a case main body 2, and an apparatus main body 10 housed in the case main body 2.

One end of an upper portion of a side surface of the case main body 2 is provided with a pen exchange lid portion 23 configured to open and close in order to exchange a pen (drawing tool) 71 of a drawing unit 7, which is described below.

The pen exchange lid portion 23 can rotate freely; for example, the portion 23 can be opened as illustrated in FIG. 1A or closed through a hinge or the like.

At a position on one side surface of the case main body 2 (in this embodiment, on the left side surface in FIG. 1A) which corresponds to a test-writing portion 61 to be described below, a medium insertion/extraction port 24 is provided. At the medium insertion/extraction port 24, a drawing medium 61*a* (see FIG. 4A and FIG. 4B) to be placed on the test-writing portion 61 can be inserted or extracted.

Figure 5:
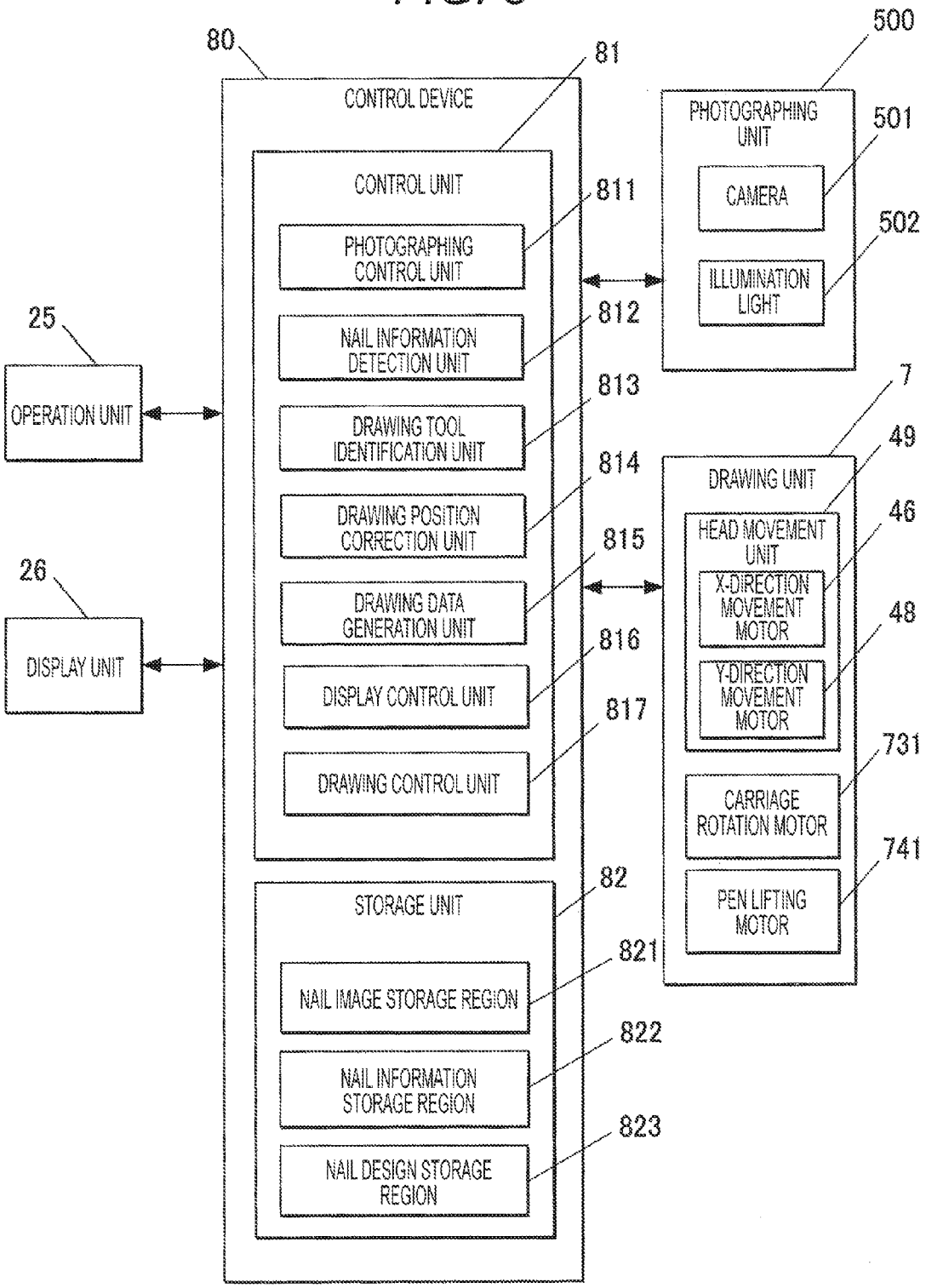
FIG. 5 is a block diagram illustrating a main portion of a control configuration of a nail printing apparatus according to an embodiment.
Figure 6:
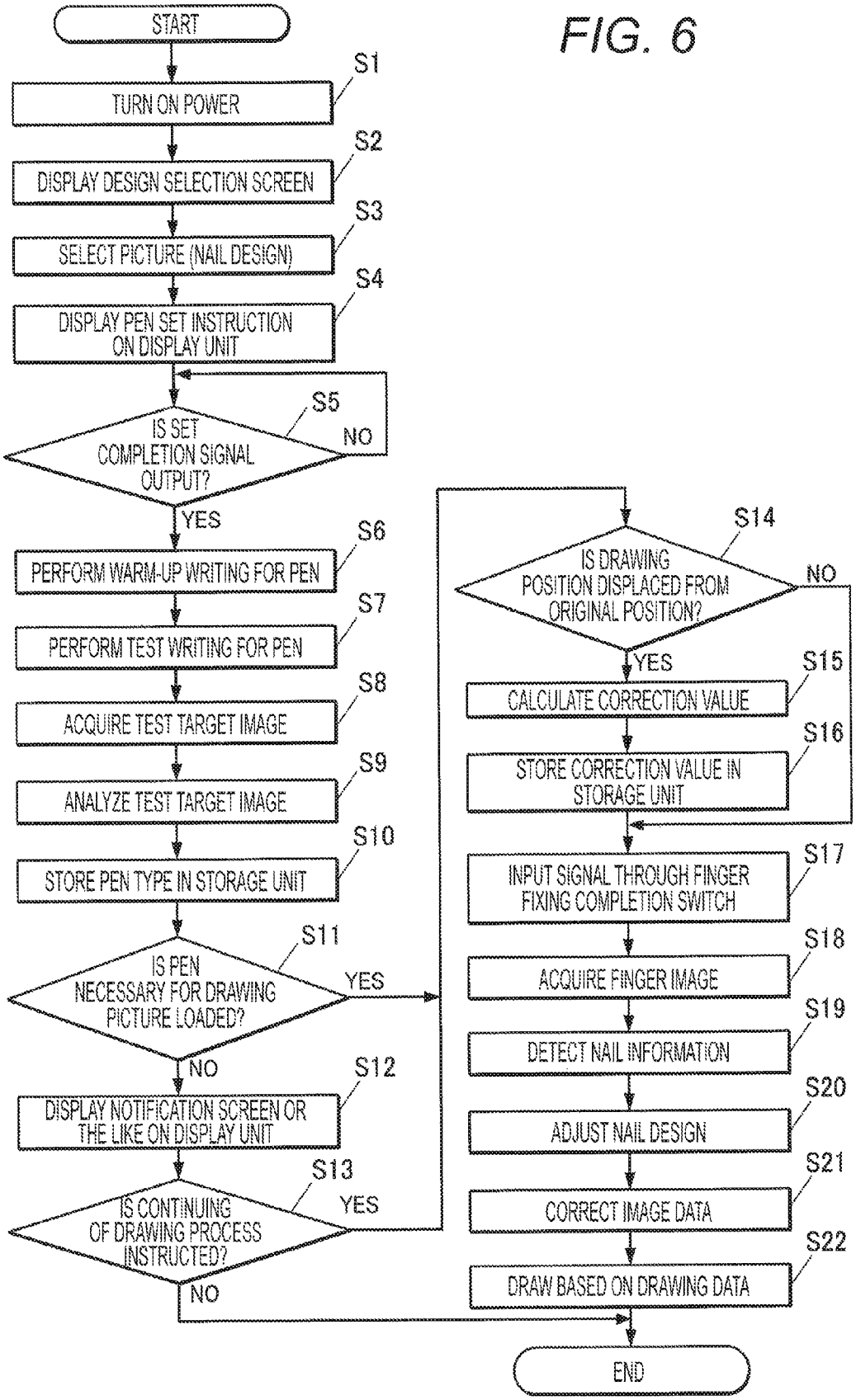
FIG. 6 is a flowchart illustrating a drawing process according to an embodiment.

An upper surface (top plate) of the case main body 2 is provided with an operation unit 25 (see FIG. 5).

The operation unit 25 is an input unit where a user inputs various instructions.

The operation unit 25 includes a plurality of unshown operation buttons for inputting various instructions, such as: a power switch button for turning on the power of the nail printing apparatus 1, a stop switch button for stopping the operation, a design selection button for selecting the design image to draw on the nail T, and a drawing start button for instructing the start of the drawing.

A substantially central portion of the upper surface (top plate) of the case main body 2 is provided with a display unit 26.

The display unit 26 is, for example, a liquid crystal display (LCD), an organic electroluminescence display, or another flat display.

In this embodiment, the display unit 26 displays, for example, a finger image obtained by photographing the print finger U1 (an image including the image of the nail T), an image of the outline of the nail T included in the finger image, a design selection screen for selecting the design image to draw on the nail T, a thumbnail image for checking the design, and the instruction screen displaying various instructions.

A touch panel may be integrated on the surface of the display unit 26. In this case, the input is made by a touch operation of a finger or a stick-like tool such as a stylus pen, which is not shown, on the surface of the display unit 26.

The apparatus main body 10 includes a lower machine frame 11, which is formed to have a substantially box-like shape and disposed at the lower part in the case main body 2, and an upper machine frame 12, which is disposed above the lower machine frame 11 and at the upper part in the case main body 2.

First, the lower machine frame 11 is described.

The lower machine frame 11 includes a rear plate 111, a bottom plate 112, a pair of left and right side plates 113*a* and 113*b*, an X-direction movement stage housing portion 114, a Y-direction movement stage housing portion 115, and a partition wall 116.

The side plates 113*a* and 113*b* have their lower ends connected to left and right ends of the bottom plate 112, respectively, so that the side plates 113*a* and 113*b* stand on the bottom plate 112.

The lower part of the rear plate 111 is depressed in two steps frontward (toward the front in the finger insertion direction).

The lower end of the rear plate 111 is connected to the front end of the bottom plate 112, and the rear plate 111 divides the region surrounded by the bottom plate 112 and the side plates 113*a* and 113*b* into the front and rear sections.

The space formed behind the depressed rear plate 111 corresponds to the X-direction movement stage housing portion 114 and the Y-direction movement stage housing portion 115 (see FIG. 1B).

The X-direction movement stage housing portion 114 houses an X-direction movement stage 45 of the drawing unit 7 when the drawing unit 7 has moved forward (toward the front in the finger insertion direction).

In the Y-direction movement stage housing portion 115 is disposed a Y-direction movement stage 47 of the drawing unit 7.

The partition wall 116 is provided inside the lower machine frame 11 to divide the space in the front of the inside of the lower machine frame 11 (space surrounded by the rear plate 111, the bottom plate 112, and the side plates 113*a* and 113*b* on the front side in the finger insertion direction) into the upper and lower sections. The partition wall 116 is provided substantially horizontally, and has its left and right ends connected to the side plates 113*a* and 113*b*, respectively and has its rear end connected to the rear plate 111.

The lower machine frame 11 is integrated with a finger fixing unit 30 (see FIG. 1B).

The finger fixing unit 30 includes a finger acceptance unit 31 that accepts a finger with a nail T on which the design is drawn (this finger is hereinafter referred to as "print finger U1"), and a finger retraction unit 32 that retracts the other fingers (these fingers are hereinafter referred to as "non-print fingers U2") than the print finger U1 of the hand with the print finger U1.

The finger acceptance unit 31 is disposed at the substantial center of the lower machine frame 11 in the width direction above the partition wall 116.

The space divided by the partition wall 116 into the lower section of the lower machine frame 11 constitutes the finger retraction unit 32.

Figure 3:
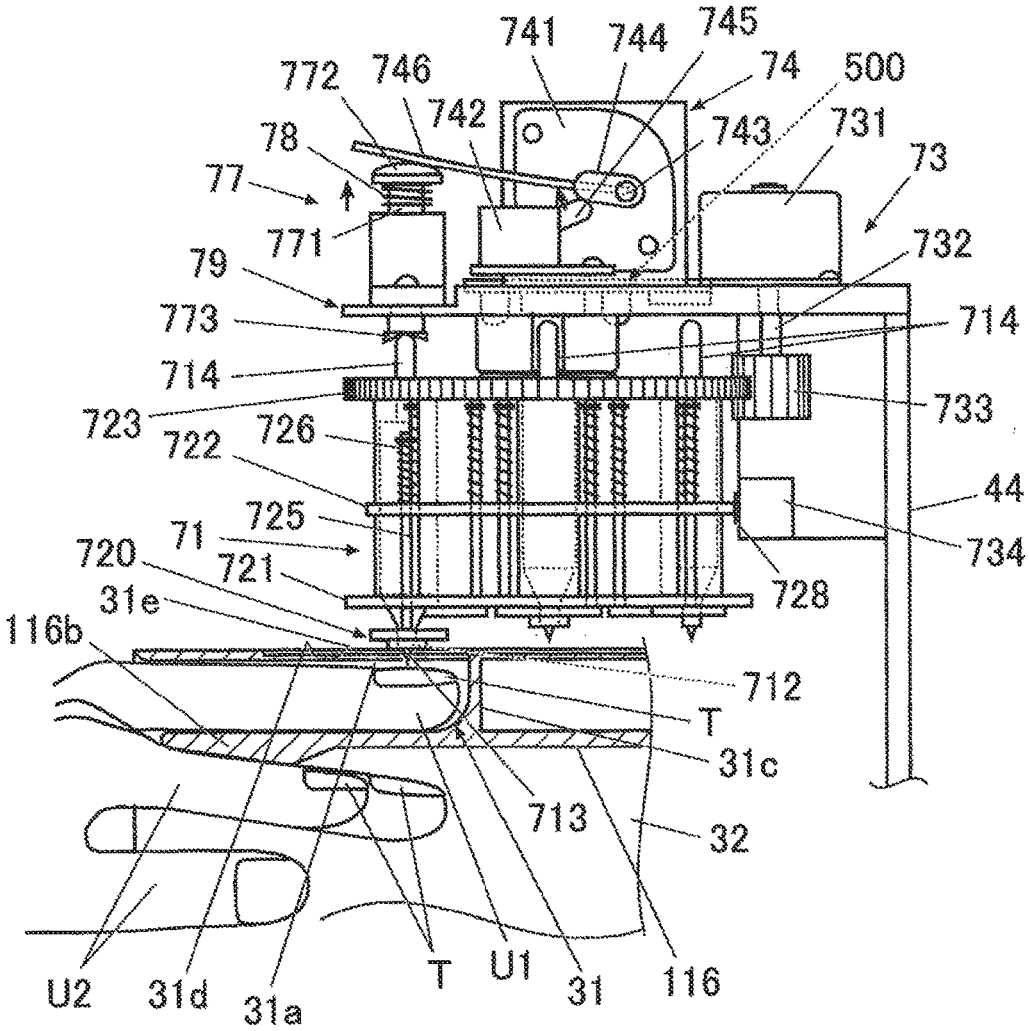
FIG. 3 is a side view of a pen carriage and a pen supported thereby in the drawing state with a finger inserted into a finger fixing unit.

For example, in the case of drawing a design on the nail T of the third finger, the third finger is inserted into the finger acceptance unit 31 as the print finger U1, and the other four fingers (thumb, first finger, second finger, and fourth finger) as the non-print fingers U2 are inserted into the finger retraction unit 32 (see FIG. 3).

The finger acceptance unit 31 is open toward the front of the lower machine frame 11 (to the front in the print finger insertion direction), and is sectioned by a finger placement portion 116*a* that constitutes a part of the partition wall 116 on the lower side, a partition 31*a* on opposite sides, and a partition 31*c* on the back side (see FIG. 3).

The finger placement portion 116*a* is to have the finger (print finger U1) with the nail T, on which the design is drawn, placed on the X-Y plane.

The upper side of the finger acceptance unit 31 is sectioned by a ceiling portion 31*d*.

The ceiling portion 31*d* is provided with a window 31*e* for exposing the nail T of the print finger U1 inserted into the finger acceptance unit 31 (see FIG. 3).

On each of the opposite sides of the front surface of the lower machine frame 11 and on the upper surface of the partition wall 116, a front wall 31*f* (see FIG. 1A) that covers the front surface of the lower machine frame 11 is provided to stand.

On the upper surface of the partition wall 116, a pair of guide walls 31*g* (see FIG. 1A) is provided. The guide walls 31*g* have a shape narrowing from the end of the front wall 31*f* near the center toward the finger acceptance unit 31 so as to guide the print finger U1 into the finger acceptance unit 31.

A user can have the partition wall 116 held between the print finger U1 inserted into the finger acceptance unit 31 and the non-print fingers U2 inserted into the finger retraction unit 32. This enables the print finger U1 to be stably fixed in the finger acceptance unit 31.

In this embodiment, a projection 116*b* projecting downward is formed in the front end of the partition wall 116.

The projection 116*b* may have a tapered shape whose thickness gradually decreases toward the front and gradually increases toward the back, or have a structure in which the thickness of the projection 116*b* is large relative to the depression at the back side of the partition wall 116.

With the projection 116*b* formed in the front end of the partition wall 116, the space is formed between the partition wall 116 and the drawn nail T when the non-print fingers U2 are inserted into the finger retraction unit 32 as illustrated in FIG. 3. This can prevent the finger nail T from touching the lower surface of the partition wall 116 so that the ink does not adhere to the apparatus side, or prevent the nail design on the nail T from being ruined.

The test-writing portion 61 for test-writing for the pen 71, which is described below, is provided on the upper surface of the lower machine frame 11 and beside the finger acceptance unit 31 (at the position corresponding to the medium insertion/extraction port 24 of the case main body 2, and on the left side in FIG. 1A) within the range where the drawing with the drawing head 70 is possible.

In this embodiment, the test-writing portion 61 also serves as a portion for performing a warm-up writing to prevent the blurring at the start of writing with the pen nib (tip portion) 713.

The test-writing portion 61 is formed by having a part of the upper surface of the lower machine frame 11 depressed, and the height of the test-writing portion 61 is preferably substantially equal to the height of the nail T of the print finger U1 when the print finger U1 is inserted into the finger acceptance unit 31.

The test-writing portion 61 is a flat-plate portion and the drawing medium 61*a* inserted through the medium insertion/extraction port 24 of the case main body 2 can be placed on the test-writing portion 61.

The drawing medium 61*a* placed on the test-writing portion 61 may be any medium on which the warm-up writing for the pen nib (tip portion) 713 can be performed, and may be, for example, a sheet of paper.

Figure 4A:
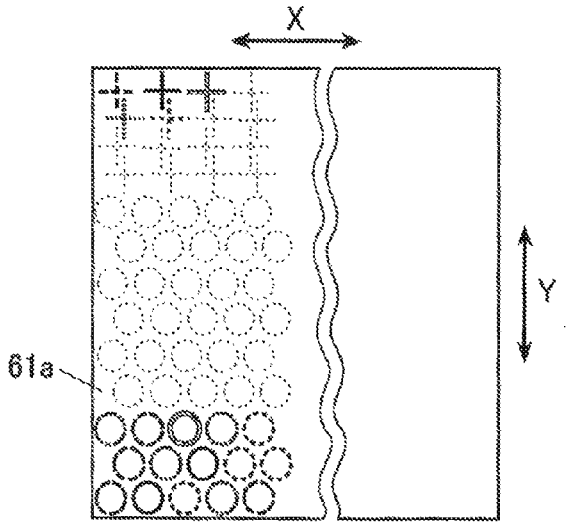
FIG. 4A and FIG. 4B are plan views illustrating a drawing example in the case where warm-up writing and test-writing are performed on a drawing medium in a test-writing portion.
Figure 4B:
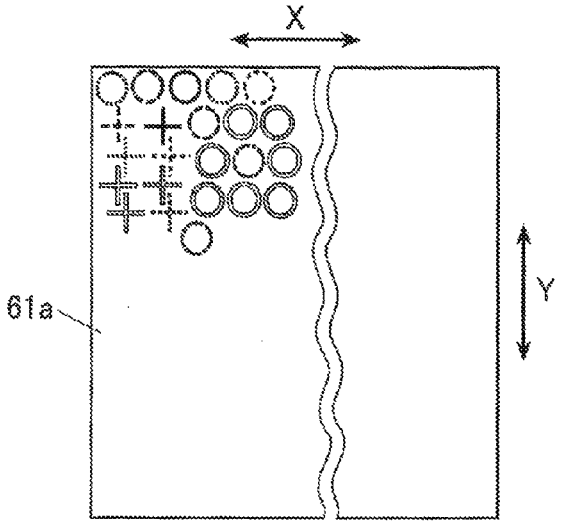

Each of FIG. 4A and FIG. 4B illustrates an example of figures to be drawn on the drawing medium 61*a* placed on the test-writing portion 61 in the warm-up writing and the test-writing on the drawing medium 61*a*.

Figure 4C:
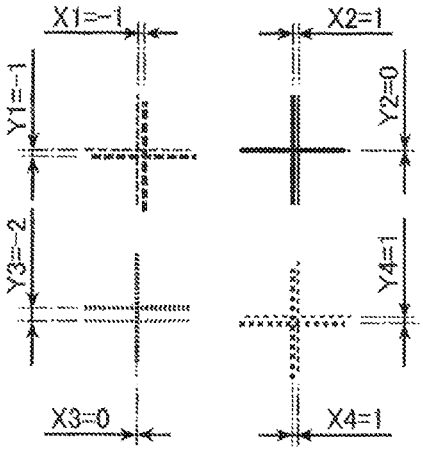
FIG. 4C is an explanatory view for describing the displacement between the position of a figure to be tested and the position where the figure should originally be drawn.

FIG. 4C is an explanatory view for describing the displacement between the position of the figure to be tested and the position where the figure should originally be drawn.

In this embodiment, the test-writing for the pen 71 is carried out in order to detect and identify the type of pen 71 as the drawing tool loaded in the pen carriage 72 and determine whether the pen 71 is the type of pen necessary to draw a design image selected to be drawn on the surface of the nail T as the drawing target (draw target surface), and also determine whether the drawing position of the pen 71 as the drawing tool is displaced from the position where the drawing should originally be performed.

Here, the type of pen 71 refers to the type of ink contained in the pen 71, and specifically, for example, what kind of color the ink has or whether the ink contains lame or not.

The type of pen 71 identified based on the figure drawn on the test-writing portion 61 is not limited to the type of ink. For example, the type of pen 71 may include the width of the pen nib 713 of the pen 71 (FIG. 2B, FIG. 2C, etc.).

The figure drawn in the test-writing is preferably the figure that easily specifies the drawing position of the pen 71, and is, for example, "+" as illustrated in FIG. 4A to FIG. 4C.

In this case, "+" is drawn by having the pen 71 draw a line in the X-direction (X direction in FIG. 1A, the width direction of the apparatus) and a line in the Y-direction (Y direction in FIG. 1B, the depth direction of the apparatus) so that the lines are orthogonal to each other.

The figure to be drawn in the test-writing is not limited to "+" but may be "○" or "•".

Drawing at least one point with the pen 71 enables the identification of the type and the drawing position of the pen 71.

However, the blurring at the start of the writing may occur depending on the pen 71. If the figure is one point and the blurring occurs in the writing of one point, this point is not drawn perfectly, in which case the type and the drawing position of pen 71 cannot be identified.

In view of this, for identifying the type and drawing position of the pen 71 for sure, the figure such as "+" including lines with a certain degree of length and the cross between the lines is preferably drawn in the test-writing.

In this embodiment, as described below, the test-writing is carried out for each of the pens (in this embodiment, eight pens as described below) loaded in the pen holder (in this embodiment, a pen cylindrical member 761 as described below, see FIG. 2A) prepared in the pen carriage 72, regardless of whether the pen 71 is actually loaded or not. After that, the figure that has been drawn in the test-writing is photographed with a camera 501 in a photographing unit 500.

Therefore, it is preferable that the figures for the test-writing (for example, "+") are drawn in the entire area that can be captured by one photographing with the camera 501.

In the test-writing of the "+", for example, the signs are preferably drawn displaced little by little from each other within the test-writing portion 61 so that the signs do not overlap with each other.

As described above, the test-writing portion 61 of this embodiment also serves as a warm-up writing portion for the pen nib (tip part) 713. Before the image data are drawn on the nail T, the pen 71 is lifted down onto the drawing medium 61*a* and draws a predetermined figure such as "○" or "∞" for the warm-up. This can make the pen nib 713 ready for the drawing.

Accordingly, it is possible to prevent the pen nib 713 from making a blurring at the start of drawing because the pen nib 713 had dried up or been in lack of ink.

The predetermined figure to be drawn for the warm-up writing is not limited to the particular figure but the figure is preferably a simple one that uses the entire circumference of the pen nib and that does not consume too much ink, such as "○" or "∞".

In the warm-up writing of "○" or "∞", the figures are preferably drawn displaced little by little from each other within the test-writing portion 61 so that the figures do not overlap with each other in each warm-up writing.

In this embodiment, before the start of the drawing, the pen nib 713 is warmed up by drawing a figure such as "○" in a blank area on one end side of the drawing medium 61*a* (for example, on the front side in the Y-direction and on the left side in the X-direction of the drawing medium 61*a*) as illustrated in FIG. 4A.

After that, in another blank area on the other end side of the drawing medium 61*a* (for example, on the back side in the Y-direction and on the left side in the X-direction of the drawing medium 61*a*), the figure such as "+" is drawn as the test-writing.

For example, as illustrated by dashed lines in FIG. 4A, the figures "○" are drawn for warm-up from one end side toward the other end side of the drawing medium 61*a* while the positions of the figures are displaced little by little, and the figures "+" are drawn for test-writing from the other end side toward the one end side of the drawing medium 61*a* while the positions of the figures are displaced little by little. When the blank area in the line is filled up with the figures, the pen is displaced in the X-direction (for example, to the right in the X-direction in FIG. 4A), and the figures "○" for the warm-up and the figures "+" for the test-writing are similarly written from the one end side and the other end side of the drawing medium 61*a*, respectively, while the positions are displaced from each other.

The position where the figure such as "○" is drawn for the warm-up writing and the position where the figure such as "+" is drawn for the test-writing are not limited to the aforementioned positions.

In another example, as illustrated in FIG. 4B, the blank area may be filled up with both the figure "○" for the warm-up writing and the figure"+" for the test-writing without separating the area.

When the entire surface of the drawing medium 61*a* is filled with the figures "○" and "+" and no longer contains the blank area, the display unit 26 displays the screen "please exchange the paper" to show the drawing medium 61*a* needs to be exchanged.

In this case, the user extracts the drawing medium 61*a* from the medium insertion/extraction port 24 and inputs the new medium; then, another warm-up writing or test-writing can be carried out on the new drawing medium 61*a*.

If, for example, the drawing medium 61*a* is rolled paper, the drawing medium 61*a* is pulled out of the roll as soon as the medium 61*a* runs out of the drawing space, so that another warm-up writing or test-writing can be carried out on the new drawing surface.

The drawing unit 7 includes, for example: the drawing head 70 including the drawing pen 71, a unit support member 44 that supports the drawing head 70, the X-direction movement stage 45 for moving the drawing head 70 in the X-direction (in X-direction, left-right direction of the nail printing apparatus 1 in FIG. 1A), an X-direction movement motor 46, the Y-direction movement stage 47 for moving the drawing head 70 in the Y-direction (in Y-direction, front-back direction of the nail printing apparatus 1 in FIG. 1B), and a Y-direction movement motor 48.

Figure 2A:
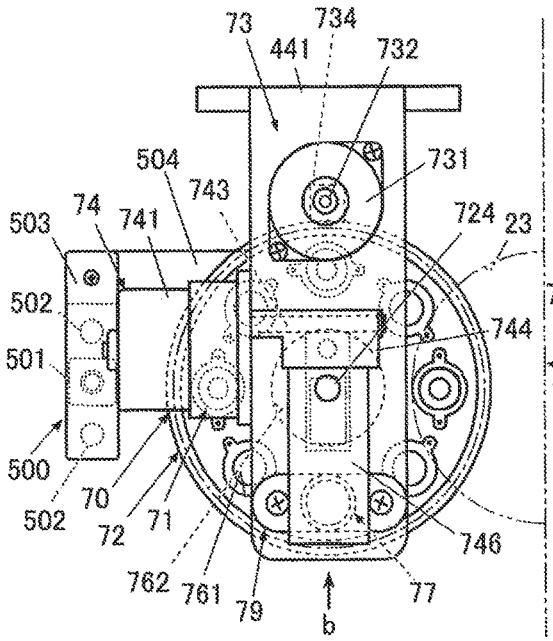
FIG. 2A is a top view of a drawing head according to an embodiment.
Figure 2B:
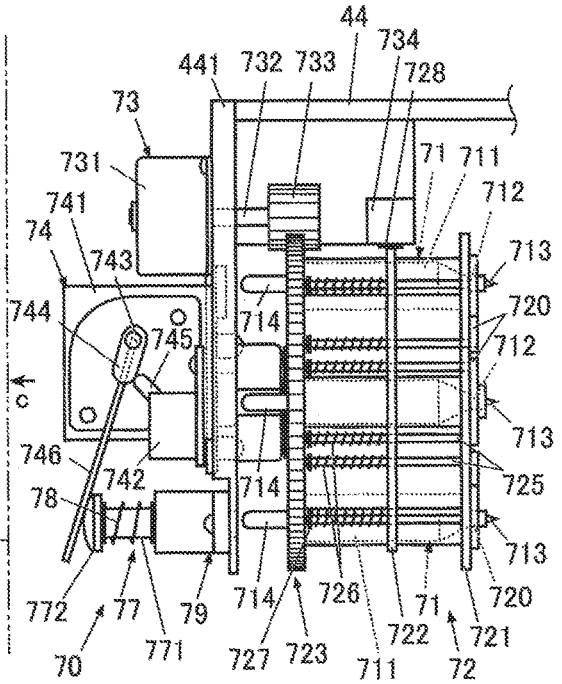
FIG. 2B is a front view of the drawing head in FIG. 2A which is viewed from an arrow-b direction.
Figure 2C:
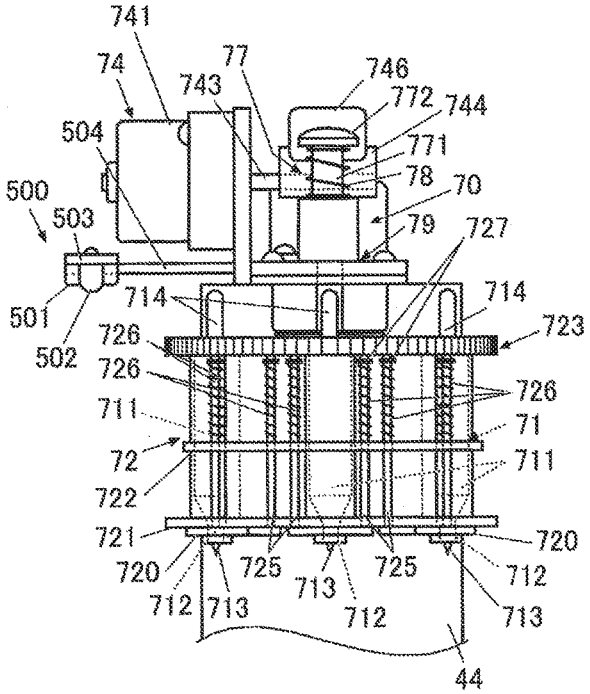
FIG. 2C is a side view of the drawing head in FIG. 2A which is viewed from an arrow-c direction.

FIG. 2A is a top view of the drawing head 70.

FIG. 2B is a front view of the drawing head 70 of FIG. 2A viewed from an arrow-b direction.

FIG. 2C is a side view of the drawing head 70 of FIG. 2A viewed from an arrow-c direction.

As illustrated in FIG. 2A to FIG. 2C, in this embodiment, the drawing head 70 includes the rotatable pen carriage 72 that can hold a plurality of pens 71, a carriage rotation mechanism 73 that can rotate the pen carriage 72, and a pen pressing mechanism (drawing tool pressing mechanism) 74 for moving up and down the pen 71 held by the pen carriage 72.

The upper end of the unit support member 44 corresponds to a beam portion 441 that extends to the front of the nail printing apparatus 1 (to the left side in FIG. 1B) to have a substantially L-like shape. The drawing head 70 is provided for the beam portion 441.

The pen carriage 72 in this embodiment includes three disc-like members 721 to 723 (i.e., a first disc-like member 721, a second disc-like member 722, and a third disc-like member 723), a pen nib fixing member 720, a rotation shaft 724, a column 725, a coil spring 726, the pen cylindrical member 761, and a rotation shaft cylindrical member 762.

The three disc-like members 721 to 723 (the first disc-like member 721, the second disc-like member 722, and the third disc-like member 723) are disc-shaped members with substantially the same size, and the first disc-like member 721, the second disc-like member 722, and the third disc-like member 723 are stacked in this order from the bottom.

An outer circumferential surface of the third disc-like member 723 at the top is provided with teeth that engage with a gear 733 of the carriage rotation mechanism 73, and the third disc-like member 723 functions as a gear.

At a predetermined position of an outer circumferential surface of the second disc-like member 722 (for example, position corresponding to the predetermined pen cylindrical member 761), a reference indication 728 representing the reference position of the rotation of the pen carriage 72 is provided.

The reference indication 728 is, for example, a reflection cloth or reflection sheet that can be read by a photo-reflector, and in this embodiment, the reference indication 728 is fixed by being attached to the outer circumferential surface of the second disc-like member 722.

Along the circumference of the pen carriage 72, eight pen cylindrical members 761 that open at the top and bottom and hold the pens 71 are provided along the circumference of the pen carriage 72.

In this embodiment, each of the three disc-like members 721 to 723 is provided with a penetration hole, which is not shown, at the position where the pen cylindrical member 761 is disposed. The pen cylindrical member 761 is inserted through this penetration hole to be provided inside each of the three disc-like members 721 to 723.

The number of pen cylindrical members 761 provided for the pen carriage 72 is not limited in particular and may be either more than or less than eight. When more pen cylindrical members 761 are provided, more pens 71 can be held at the same time, in which case the complicated nail design can be drawn with various types of ink.

Note that it is not always necessary that all the pen cylindrical members 761 hold the pens 71. FIG. 2A, for example, illustrates an example in which four out of the eight pen cylindrical members 761 hold the pens 71.

On both sides of the pen penetration hole of each of the first disc-like member 721 and the second disc-like member 722, a penetration hole (not shown) for an assistant shaft, through which the column 725 is inserted, is formed.

Below the first disc-like member 721, the pen nib fixing member 720 is disposed to cover the lower opening of each pen cylindrical member 761.

The pen nib fixing member 720 is a fixing member that fixes the nib side of the pen shaft portion 711 of the pen 71 as the drawing tool.

The pen nib fixing member 720 includes the column 725 that is fixed in parallel to the pen shaft portion 711 of the pen 71 and moves up and down with the pen 71, and the coil spring 726 as an auxiliary shaft energizing member that energizes the column 725 in the upward direction in the state that the external force is not applied.

The column 725 is fixed to the pen nib fixing member 720 in parallel to the pen shaft portion 711 of the pen 71.

Near the upper end portion of the column 725, an E ring 727 that extends outward is provided.

The outer diameter of the E ring 727 is larger than the inner diameter of the penetration hole for the column in the second disc-like member 722 and the outer shape of the coil spring 726.

Along the outer circumference of the pen 71 and between the E ring 727 and the upper surface of the second disc-like member 722, the coil spring 726 is wound.

In the state that the external force is not applied, the coil spring 726 is to energize the column 725 in the upward direction.

In this embodiment, the coil spring 726 as the auxiliary shaft energizing member is disposed along the outer circumference of the pen 71. The coil spring 726 is an elastic member that compresses when the pen 71 is pressed down by the external force and restores to the original state by resisting against the external force.

The coil spring 726 has one end in contact with the lower surface of the E ring 727 and the other end in contact with the upper surface of the second disc-like member 722.

The coil spring 726 is to hold the pen 71 at the position where the pen nib 713 is not in contact with the nail T while the drawing is not carried out. That is to say, the column 725 is energized by the coil spring 726 in the upward direction (upward direction in FIG. 2B), and when the external force is not applied, the upper end of the column 725 is held in contact with the lower surface of the third disc-like member 723. In this state, the pen nib 713 is in the position near the lower surface of the first disc-like member 721, and the pen nib 713 is not brought into contact with the nail T even if the pen carriage 72 is moved above the finger acceptance unit 31.

At the substantial center of each of the three disc-like members 721 to 723, a penetration hole (not shown) is formed. Through the penetration hole at the center, the rotation shaft cylindrical member 762 is inserted. The rotation shaft cylindrical member 762 is provided penetrating through the three disc-like members 721 to 723.

The rotation shaft cylindrical member 762 has the rotation shaft 724 inserted therethrough. The rotation shaft 724 is provided suspended from the beam portion 441. The pen carriage 72 can rotate substantially horizontally around the rotation shaft 724.

It is preferable that the rotation shaft 724 is provided with washers above and below the pen carriage 72 and the lower end of the rotation shaft 724 is provided with an E ring or the like as a stopper. This enables the pen carriage 72 to smoothly rotate around the rotation shaft 724.

The pen 71 is a drawing tool that draws on the surface of the nail T with the pen nib in contact with the surface of the nail T. The pen 71 is held by the pen cylindrical member 761.

The pen 71 as a drawing tool has the pen nib 713 provided at the tip of the stick-like pen shaft portion 711 (lower side in FIG. 2B).

In this embodiment, the tip of the pen shaft portion 711 is provided with an engagement portion 712 with smaller diameter than the pen shaft portion 711. The engagement portion 712 is the portion to be fitted to the pen nib fixing member 720. By fitting the engagement portion 712 into the pen nib fixing member 720, the pen nib 713 is fixed firmly to prevent the shake of the pen nib 713.

Instead of the structure having the pen shaft portion 711 fitted to the engagement portion 712, the both may be fixed to each other by a screw or the like.

Above the pen shaft portion 711, a stick-like projection 714 is formed. This projection 714 is to be pressed by a slide pin 77 which is described below.

The projection 714 also functions as a knob to be pinched by user's fingers when the user removes the pen 71 for the exchange.

In this embodiment, the end of the projection 714 is hemispherical. The shape of the end of the projection 714 is not limited to the illustrated shape but may be any shape that can be pressed stably and be easily pinched by the user. The shape may be, for example, spherical or flat.

The inside of the pen shaft portion 711 is an ink storage portion containing ink.

The pen shaft portion 711 may contain a variety of ink.

There is no particular limitation on the viscosity of the ink or the particle diameter (particle size) of the coloring material. The ink may be, for example, ink containing gold or silver lame, white ink, UV-curable ink, gel, undercoat ink, topcoat ink, other ink for manicure.

In this embodiment, the pen 71 is used in the manner that, for example, the pen nib 713 is brought into contact with the surface of the nail T and pressed against the surface thereof, so that the ink is leaked out of the pen shaft portion 711. The ink is applied on the surface of the nail T with which the pen nib 713 is in contact. The pen nib 713 of the pen 71 is, for example, a ball.

The pen 71 is not limited to the ballpoint pen.

The pen 71 may be a fiber-tipped pen, which has a fiber pen nib impregnated with ink, or a brush-type pen, which has a brush-like pen nib impregnated with ink.

The thickness of the pen nib 713 can be selected as appropriate.

In a case where the pen carriage 72 holds the plurality of pens 71, the pens 71 may be the pens with the same type of pen nib 713 or the pens with the different types of pen nib 713.

The pen 71 is held in the pen carriage 72 just by being inserted into the pen cylindrical member 761 from above. Therefore, it is easy to exchange the pen 71 simply by opening the pen exchange lid portion 23 of the case main body 2 and picking up the projection 714 with a hand or a pin, for example.

Accordingly, the user can have various kinds of nail designs by changing the pen 71 to be loaded in the pen carriage 72 with the different type of ink or different type of pen nib 713 in accordance with the desired nail design.

As illustrated in FIG. 3C, the carriage rotation mechanism 73 includes a carriage rotation motor 731, and the gear 733 that is connected to the motor 731 through a rotation shaft 732 and engaged with the gear 723.

In this embodiment, driving the motor 731 rotates the rotation shaft 732, which induces the rotation of the gear 733 attached to the rotation shaft 732. This produces the rotation of the gear 723 that engages with the gear 733. Thus, the pen carriage 72 is rotated in the left-right direction.

The carriage rotation mechanism 73 includes an indication reader 734 for reading the reference indication 728 of the pen carriage 72.

The indication reader 734 includes, for example, a photo-reflector that can read the reference indication 728 including a reflection cloth or reflection sheet.

Every time the indication reader 734 reads the reference indication 728, the indication reader 734 outputs the read result to a drawing control unit 817.

The pen pressing mechanism 74 is to press down the pen 71 as the drawing tool loaded in the pen carriage 72.

In this embodiment, the pen pressing mechanism 74 includes a pen lifting motor 741, a micro-switch 742, and a plate spring (pressing member) 746.

The motor 741 is a stepping motor with a gear head, and the rotation shaft 743 is provided with a resin fixing unit 744 for fixing the plate spring 746.

In this fixing unit 744, a base end of the plate spring 746 is embedded.

This enables the fixing unit 744 and the plate spring 746 to rotate following the rotation shaft 743 of the motor 741.

Below the fixing unit 744 is provided a lever 745 for the micro-switch 742. Thus, the fixing unit 744 is brought into contact with the lever 745 of the micro-switch 742 upon the downward rotation of the fixing unit 744, thereby turning on the micro-switch 742.

The plate spring 746 abuts on the upper part of the slide pin 77 and can press down the slide pin 77 and the pen 71 in contact with the slide pin 77. The plate spring 746 is formed of an elastic member that can deform to be bent when being pushed up by the slide pin 77 and the pen 71.

The plate spring 746 in this embodiment is a plate-shaped spring and has a free end side located above the slide pin 77.

The plate spring 746 is sufficiently wide relative to the slide pin 77, and in contact with the slide pin 77 at a point or in a plane.

Since the plate spring 746 is sufficiently wide and long relative to the slide pin 77, the plate spring 746 will not go off from the slide pin 77 and can press down the pen 71 in contact with the slide pin 77 stably in the perpendicular direction.

As the material of the plate spring 746, a usual spring member can be used, such as "SUS", "spring steel", "phosphor bronze", or "beryllium copper". Examples of "SUS" include "SUS301-H", "SUS304", and "SUS316".

The material of the plate spring 746 is not limited to those above.

The pressing force by the plate spring 746 is correlated with the amount of bending of the spring and the length of the plate spring 746 (i.e., the distance from the base end to the free end that operates on the object to be pressed). If the plate spring 746 is short, the softer material can be used to provide the sufficient pressing force; if, on the other hand, the plate spring 746 is long, the hard material is necessary to provide the sufficient pressing force.

The pressing force can be adjusted by the spring constant, which is determined based on the material of the plate spring 746 and the shape of the plate spring 746 (length, width, etc.), and is set as appropriate in accordance with the space where the plate spring 746 is disposed, for example.

The slide pin 77 can move vertically, and in the state that the slide pin 77 is at the bottom, the lower end of the slide pin 77 is able to abut on the upper part of the pen 71.

Specifically, in this embodiment, the slide pin 77 includes a pin shaft portion 771, and a pin head 772 provided on the pin shaft portion 771, having larger diameter than the pin shaft portion 771, and stretching outward more than the pin shaft portion 771. The lower end of the pin shaft portion 771 corresponds to a pressing portion that can abut on the upper part of the pen 71. The pressing portion is formed to have, for example, a conical depression shape to receive the projection 714 of the pen 71.

A coil spring 78 is disposed between a pin attachment member 79 and the pin head 772 along the outer circumference of the pin shaft portion 771 of the slide pin 77. When the slide pin 77 is pressed down by the external force, the coil spring 78 is compressed and tries to restore to the original state by resisting against the external force.

Any other elastic member can be used as the coil spring 78 if the member is compressed when the slide pin 77 is pressed down by the external force and tries to restore to the original state by resisting against the external force.

The slide pin 77 and the coil spring 78 are attached above the beam portion 441 by the pin attachment member 79.

The coil spring 78 provided along the outer circumference of the pin shaft portion 771 has one end fixed by the upper surface of the pin attachment member 79 and the other end fixed abutting on the lower surface of the pin head 772. When the slide pin 77 is pressed down by the external force, the coil spring 78 is compressed between the upper surface of the pin attachment member 79 and the lower surface of the pin head 772.

In this embodiment, pressing down the pin head 772 of the slide pin 77 by the plate spring 746 makes the pen 71 go down to be in contact with the surface of the nail T.

The pen 71 automatically moves up and down because the plate spring 746 deforms (elastically deforms), so that the pen 71 can be brought into contact with the nail T for sure and at the same time, the strength of a brushstroke can be maintained at the appropriate value.

The spring constant of the plate spring 746 is not that large and is set to the value of such a degree that the user does not feel pain on the nail T when the pressing force (external force) by the plate spring 746 is applied to the nail T.

Since the plate spring 746 is bent as appropriate, the shock from the up and down movement of the pen 71 is absorbed and moreover the beautiful drawing can be carried out with the pen nib 713 subjected to a constant and appropriate pressure.

The unit support member 44 is fixed to an X-direction movement unit 451 attached to the X-direction movement stage 45. The X-direction movement unit 451 is to move in the X-direction along a guide, which is not shown, on the X-direction movement stage 45 by the driving of the X-direction movement motor 46. Thus, the drawing head 70 attached to the unit support member 44 is moved in the X-direction (X-direction in FIG. 1A, left-right direction of the nail printing apparatus 1).

The X-direction movement stage 45 is fixed to a Y-direction movement unit 471 of the Y-direction movement stage 47.

The Y-direction movement unit 471 is to move in the Y-direction along a guide, which is not shown, on the Y-direction movement stage 47 by the driving of the Y-direction movement motor 48.

Thus, the drawing head 70 attached to the unit support member 44 is moved in the Y-direction (Y-direction in FIG. 1B, front-back direction of the nail printing apparatus 1).

In this embodiment, the X-direction movement stage 45 and the Y-direction movement stage 47 are configured by combining the X-direction movement motor 46 and the Y-direction movement motor 48, and ball screws and guides, which are not shown.

In this embodiment, a head movement unit 49 is further provided. The head movement unit 49 is to move the drawing head 70 including the pen 71 for drawing the design on the nail T in the X-direction and the Y-direction by the X-direction movement motor 46 and the Y-direction movement motor 48, for example.

In this embodiment, the photographing unit 500 can be moved along with the movement of the drawing head 70 by the head movement unit 49.

That is to say, the head movement unit 49 functions to move both the drawing head 70 and the photographing unit 500.

The motor 741 for moving up and down the pen 71 of the drawing unit 7, the motor 731 for rotating the pen carriage 72, the X-direction movement motor 46, and the Y-direction movement motor 48 are connected to the drawing control unit 817 of a control device 80, which is described below, (see FIG. 5) and controlled by the drawing control unit 817.

The photographing unit 500 (image acquisition unit) is to acquire the nail image (finger image including the nail image) as the image of the nail T of the print finger U1 by photographing the print finger U1 (nail T of the print finger U1) inserted in the finger acceptance unit 31.

In this embodiment, the photographing unit (image acquisition unit) 500 acquires the test target image by photographing the test target (i.e., the figure "+" in this embodiment) drawn on the test-writing portion 61 with the pen 71 as the drawing tool.

In this embodiment, the photographing unit 500 includes the camera 501 and illumination lights 502. The photographing unit 500 is fixed beside the drawing head 70.

As illustrated in FIG. 2A and FIG. 2B, a support member 504 is provided stretching sideward from the upper surface of the drawing head 70, and a substrate 503 is fixed at the free end side of the support member 504.

At the lower surface of the substrate 503, the camera 501 and the illumination lights 502 are provided opposite to the partition wall 116. The camera 501 is provided between the illumination lights 502.

The camera 501 is preferably, for example, a compact camera including a solid-state imaging element with about two million pixels or more and a lens.

In this embodiment, as described above, regardless of whether the pen 71 is actually loaded in each pen holder (in this embodiment, eight pen cylindrical members 761) in the pen carriage 72, the test-writing for the pens is sequentially conducted for each pen holder and the test target corresponding to the result of the test-writing (for example, the "+" figure) is photographed by the camera 501 of the photographing unit 500 at one time.

The photographing unit 500 can be moved together with the drawing head 70 by the head movement unit 49 that moves the drawing head 70, and photographs the nail T from at least two different positions and angles to acquire at least two nail images.

By photographing the plural images of the nail T from the different positions and angles, a nail information detection unit 812, which is described below, can accurately detect the outline of the nail T (shape of nail T), the horizontal position, the curve shape of the nail T, the vertical position (height), and the like from the acquired plural nail images.

The illumination light 502 includes, for example, a white LED, and illuminates the nail T of the print finger U1 when the camera 501 photographs the nail T.

The photographing unit 500 is connected to a photographing control unit 811 of the control device 80 (see FIG. 5), which is described below, to be controlled by the photographing control unit 811.

The image data of the nail image photographed by the photographing unit 500 are stored in a nail image storage region 821 of a storage unit 82 to be described below.

The image data of the test target image photographed by the photographing unit 500 are sent to a drawing tool identification unit 813 and a drawing position correction unit 814 (see FIG. 5) to be described below.

The control device 80 is disposed on, for example, the substrate 13 on the upper machine frame 12.

FIG. 5 is a block diagram illustrating a main part of the control configuration in this embodiment.

As illustrated in FIG. 5, the control device 80 is a computer including a control unit 81 including a central processing unit (CPU), which is not shown, and the storage unit 82 including read only memory (ROM) and random access memory (RAM), which are not shown.

The storage unit 82 stores various programs or pieces of data for operating the nail printing apparatus 1.

Specifically, the ROM of the storage unit 82 stores various programs including a nail information detection program for detecting the nail information such as the shape of the nail T and the outline of the nail T from the finger image, a drawing tool identification program for identifying the type of pen 71, a drawing position correction program for correcting the drawing position, a drawing data generation program for generating the drawing data, and a drawing program for performing the drawing process. The units in the nail printing apparatus 1 are collectively controlled by having the control device 80 execute these programs.

In this embodiment, the storage unit 82 includes the nail image storage region 821 that stores the finger image of the nail T of the print finger U1 of the user acquired by the photographing unit 500, a nail information storage region 822 that stores the nail information (such as the shape of the nail T and the outline of the nail T) detected by the nail information detection unit 812, and a nail design storage region 823 that stores the image data of the nail design to be drawn on the nail T.

From the functional point of view, the control unit 81 includes the photographing control unit 811, the nail information detection unit 812, the drawing tool identification unit 813, the drawing position correction unit 814, a drawing data generation unit 815, a display control unit 816, the drawing control unit 817, and the like. The functions of the photographing control unit 811, the nail information detection unit 812, the drawing tool identification unit 813, the drawing position correction unit 814, the drawing data generation unit 815, the display control unit 816, the drawing control unit 817, and the like are achieved by the cooperation between the CPU in the control unit 81 and the programs stored in the ROM in the storage unit 82.

The photographing control unit 811 controls the camera 501 and the illumination lights 502 of the photographing unit 500 so that the camera 501 photographs the finger image including the image of the nail T of the print finger U1 inserted in the finger acceptance unit 31.

In this embodiment, the photographing control unit 811 acquires at least two finger images from the different positions and angles (for example, from right above the nail T and obliquely above the nail T) by moving the camera 501.

That is to say, the photographing control unit 811 causes the camera 501 to acquire the image of the nail T from right above and the image of the nail T from obliquely above.

The image data of the finger image acquired by the photographing unit 500 may be stored in the storage unit 82.

In this embodiment, the figure "+" is drawn as the test target in the test-writing portion 61 and the photographing control unit 811 causes the camera 501 to photograph this test target and acquires the test target image.

As described above, in the case where the pen carriage 72 is provided with the plurality of pen cylindrical members 761, a plurality of test targets (i.e., figures "+") is drawn with the pens in all the pen cylindrical members 761. The photographing control unit 811 causes the camera 501 to photograph these test targets at one time and acquires one test target image.

It is not always necessary that all the test targets are taken within one image. For example, each test target for each of the pen cylindrical members 761 may be photographed one time and the photographing may be carried out a plurality of times so that the plurality of test target images can be acquired.

The nail information detection unit 812 detects the nail information on the nail T on the basis of the finger image of the print finger U1 inserted into the finger acceptance unit 31 photographed by the camera 501.

The nail information refers to, for example, the outline of the nail T (nail shape, the horizontal position of the nail T), the distribution of the height of the nail T (the position of the nail T in the vertical direction, hereinafter also referred to as "vertical position of nail T" or simply "position of nail T") within the outline of the nail T, and the distribution of the inclination angle of the surface of the nail T (inclination angle of nail T, nail curvature) relative to the X-Y plane within the outline of the nail T.

Specifically, the nail information detection unit 812 detects the position or outline (shape and size) of the nail T from the finger image of the print finger U1 acquired by the camera 501, and acquires the outline as the information represented by x and y coordinates.

The nail information detection unit 812 is to detect the outline (shape) of the nail T on the basis of the difference in color between the nail T and the other finger part from the finger image of the print finger U1 acquired by the camera 501.

Note that how the nail information detection unit 812 detects the outline (shape) of the nail T is not particularly limited and another procedure may be employed.

The nail information detection unit 812 detects the inclination angle (nail curvature) of the nail T on the basis of at least two finger images photographed by the camera 501.

In this embodiment, the plural finger images are acquired by photographing the nail T at least twice from the different positions and angles (for example, from right above the nail T and from obliquely above the nail T).

The nail information detection unit 812 detects the distribution of the inclination angles (nail curvatures) within the outline of the nail T of the user from the difference in shape and position observed from these images.

Note that how the nail information detection unit 812 detects the inclination angle (nail curvature) of the nail T is not particularly limited and another procedure may be employed.

The content of the nail information to be detected by the nail information detection unit 812 is not limited the above one. The nail information may be a part of the above items (such as the outline of the nail T) or additionally contain another item.

The drawing tool identification unit 813 detects to identify the type of pen 71 as the drawing tool loaded in the pen carriage 72 on the basis of the test target image photographed by the photographing unit 500, and determines whether the type of pen 71 can be used to draw the particular nail design selected by the user on the nail T as the drawing target surface. That is to say, the drawing tool identification unit 813 determines whether the pen 71 loaded in the pen carriage 72 includes the type necessary to draw the particular nail design.

Specifically, the drawing tool identification unit 813 analyzes the image of the portion of the test target image corresponding to the pen cylindrical member 761.

If nothing is drawn at the position corresponding to the pen cylindrical member 761, the drawing tool identification unit 813 determines that the pen 71 is not loaded in the pen cylindrical member 761 or that the pen 71 is loaded but does not discharge the ink so that the drawing is impossible.

If the figure such as "+" is drawn at the position corresponding to the pen cylindrical member 761, the drawing tool identification unit 813 identifies the type of pen 71 (color, etc. drawn by the pen 71) from the figure such as "+" and stores the type of pen 71 while associating the type with the position of the pen cylindrical member 761.

For example, in this embodiment, if the pen carriage 72 has the eight pen cylindrical members 761, the image is analyzed and examined at the eight corresponding positions and the results of determination is stored while being associated with the pen cylindrical member 761.

The type of pen 71 to be identified by the drawing tool identification unit 813 is not limited to the color. For example, the thickness of the line drawn by the pen 71 may be identified as the type of pen 71.

For example, the drawing tool identification unit 813 determines that, out of the eight pen cylindrical members 761, a first pen cylindrical member 761 holds the pen 71 with red ink, a third pen cylindrical member 761 holds the pen 71 with yellow ink, a fifth pen cylindrical member 761 holds the pen 71 with white ink including lame, a seventh pen cylindrical member 761 holds the pen 71 with green ink, and second, fourth, sixth, and eighth pen cylindrical members 761 do not hold the pen 71 or hold the pen but the drawing is impossible.

Then, if the selected particular nail design is to be drawn on the nail T using the red ink, the white ink including lame, and the pink ink and the pen 71 with the pink ink is not loaded in any of the pen cylindrical members 761 in the pen carriage 72, the drawing tool identification unit 813 determines that the pen carriage 72 does not have the type of pen 71 which is necessary to draw the particular nail design.

Here, even if the pen 71 with the ink that is not necessary to draw the particular nail design is loaded in the pen cylindrical member 761 in the pen carriage 72 (in the above example, the third and seventh pen cylindrical members 761), a problem will not occur as long as such pens 71 are not used in the drawing.

That is to say, as long as the pen 71 necessary to draw the particular nail design is loaded in any of the pen cylindrical members 761, the drawing tool identification unit 813 determines that the pens 71 can be used to draw the particular nail design even if the other pen 71 is included.

If the drawing tool identification unit 813 has determined that the pen 71 loaded in the pen carriage 72 can be used to draw the particular nail design, the drawing tool identification unit 813 stores the type of pen 71 while associating the type with the position of the pen cylindrical member 761 where the pen 71 is loaded.

On the other hand, if the drawing tool identification unit 813 has determined that the pen 71 loaded in the pen carriage 72 cannot be used to draw the particular nail design, the display unit 26 shows this fact as described below.

The drawing position correction unit 814 determines whether the drawing position of the pen 71 as the drawing tool is displaced from the position where the pen should originally be placed (normal drawing position) on the basis of the test target image photographed by the photographing unit 500. If it has been determined that the drawing position is displaced, the correction value for correcting the drawing position to the normal drawing position is calculated. The calculated correction value is stored in the storage unit 82 while being associated with the pen 71 (position of the pen cylindrical member 761 where the pen 71 is loaded).

FIG. 4C is an explanatory view illustrating an example of the displacement of each pen 71.

In FIG. 4C, the thick line expresses an example of the image (test target image) of the figure drawn by the pen 71 actually on the drawing medium 61*a* placed on the test-writing portion 61.

In FIG. 4C, the thin line expresses the normal drawing position where the figure should originally be drawn with the pen 71. The normal drawing position expressed by the thin line is not the line actually drawn on the drawing medium 61*a* but the virtual one generated in the data processing by the drawing position correction unit 814.

In the example illustrated in FIG. 4C, the test target image "+" on the upper left is displaced by −1 dot in the X-direction and −1 dot in the Y-direction from the normal drawing position (X1=−1, Y1=−1).

In this case, the drawing position correction unit 814 calculates the correction value so as to move the drawing position of the pen 71 by this amount of displacement in the drawing (i.e., displace by +1 dot in the X-direction and +1 dot in the Y direction).

The test target image "+" on the upper right is displaced by +1 dot in the X-direction from the normal drawing position but not displaced in the Y-direction (X2=+1, Y2=0).

In this case, the drawing position correction unit 814 calculates the correction value so as to move the drawing position of the pen 71 in the drawing only in the X-direction (i.e., move by −1 dot in the X-direction and 0 in the Y direction).

The test target image "+" on the lower left is not displaced in the X-direction from the normal drawing position but is displaced by −2 dots in the Y-direction (X3=0, Y3=−2).

In this case, the drawing position correction unit 814 calculates the correction value so as to move the drawing position of the pen 71 by this amount of displacement in the drawing (i.e., move by 0 in the X-direction and +2 in the Y direction).

Similarly, the test target image "+" on the lower right is displaced by 1 dot in the X-direction and by 1 dot in the Y-direction from the normal drawing position (X4=1, Y4=1).

In this case, the drawing position correction unit 814 calculates the correction value so as to move the drawing position of the pen 71 by this amount of displacement in the drawing (i.e., displace by −1 dot in the X-direction and −1 dot in the Y direction).

If the pen 71 has the thick pen nib 713 and the drawn test target has the thick line, a thinning process for extracting the center of the like is performed and based on the center position of the line, the amount of displacement is detected and the correction value is calculated.

The drawing data generation unit 815 generates the drawing data to be applied to the nail T of the print finger U1 by the drawing head 70 on the basis of the nail information detected by the nail information detection unit 812.

Specifically, the drawing data generation unit 815 magnifies, reduces, or cuts the image data of the nail design for adjustment on the basis of the shape of the nail T detected by the nail information detection unit 812 and generates the drawing data to draw on the nail T.

In this embodiment, the drawing data generation unit 815 adjusts the image data of the nail design in accordance with the shape of the nail T in accordance with the nail information detected by the nail information detection unit 812, and corrects the curved surface if necessary.

If the drawing position correction unit 814 has calculated the correction value in regard to the drawing position of the pen 71, the correction value is applied to the drawing data.

Thus, the data for drawing the nail design are generated.

The display control unit 816 controls the display unit 26 to display various pieces of image information on the display unit 26.

In this embodiment, the display control unit 816 causes the display unit 26 to display, for example, the design selection screen, the thumbnail image for checking the design, the finger image acquired by photographing the print finger U1, or various instruction screens.

In this embodiment, if the drawing tool identification unit 813 has determined that the pen 71 necessary to draw the particular nail design selected to be drawn on the nail T is not loaded in the pen carriage 72, the display control unit 816 displays this fact on the display unit 26 and notifies the user.

In this case, the display unit 26 functions as a notification unit.

The display control unit 816 may cause the display unit 26 to display how the nail design looks like if the current pen 71 is used. In this case, the display unit 26 functions as an image display unit.

For example, if the particular nail design contains a pink part but the pen 71 with the pink ink is not loaded, the display unit 26 displays the image showing the part that should be colored with pink but has the color of the pen 71 currently loaded.

In this case, if there is a plurality of colors of the pens 71 currently loaded, the design with the color close to pink may be displayed or all the patterns including the colors of the loaded pens 71 may be displayed so that the user can choose one.

On this occasion, the display unit 26 may display a message to let the user decide whether to continue the drawing process.

Moreover, if the drawing tool identification unit 813 has determined that the pen 71 loaded in the pen carriage 72 cannot be used to draw the particular nail design, the display control unit 816 may cause the display unit 26 to show one or more nail design candidates that can deal with the type of pen 71 currently loaded in the pen carriage 72, i.e., that can be drawn properly by the pen 71 currently loaded in the pen carriage 72. In this case, the display unit 26 functions as a candidate display unit.

That is to say, in the case where the pens 71 containing red ink, white ink including lame, yellow ink, and green ink are loaded in the pen carriage 72, one or more nail designs that can be drawn by four or less kinds of the red ink, the white ink including lame, the yellow ink, and the green ink are extracted from the nail design storage region 823 and displayed on the display unit 26.

If more than one nail designs are extracted from the nail design storage region 823, the display control unit 816 may display all the nail designs or any one of them or a combination thereof on the display unit 26.

The drawing control unit 817 is the control unit that outputs control signals to the drawing unit 7 on the basis of the drawing data generated by the drawing data generation unit 815 to control the pen lifting motor 741 for the pen pressing mechanism 74, the carriage rotation motor 731, the X-direction movement motor 46, and the Y-direction movement motor 48 of the drawing unit 7 so that the drawing on the nail T is carried out based on the drawing data.

As described above, in this embodiment, the drawing tool identification unit 813 identifies the type of pen 71 loaded in the pen carriage 72, and stores the position of the pen cylindrical member 761 having the pen 71 loaded therein and the type of pen 71 while associating the both.

Based on the correlation between the position of the pen cylindrical member 761 and the type of pen 71, the drawing control unit 817 determines which color part of the nail design is drawn with the pen 71 loaded in which pen cylindrical member 761, and controls the drawing unit 7 based on the determination.

In this embodiment, the drawing control unit 817 performs the test-writing or warm-up writing for the pen 71 in the test-writing portion 61 in the case where the pen 71 is exchanged or is used after a long rest.

The timing of performing the test-writing or the warm-up writing is not limited in particular but is preferably just before the start of the drawing operation.

Next, the operation and the use procedure of the nail printing apparatus 1 in this embodiment are described.

In the case of drawing with the use of the nail printing apparatus 1, first, a user turns on the power switch to activate the control device 80 (Step S1).

The display control unit 816 displays a design selection screen on the display unit 26 (Step S2).

The user operates an operation button of the operation unit 25, and selects a particular nail design to be drawn on the nail T from among a plurality of nail designs displayed in the design selection screen. Then, the operation unit 25 outputs the selection instruction signal and thus the particular nail design to be drawn on the nail T is selected (Step S3).

Upon the selection of the nail design, the control unit 81 causes the display unit 26 to display the instruction screen to request the user to set the pen 71 necessary to draw the selected particular nail design in the predetermined pen carriage 72 in the drawing head 70 (Step S4).

After setting the pen 71, the user operates the set completion button in the operation buttons in the operation unit 25. This causes the operation unit 25 to output the set completion signal.

The control unit 81 determines whether the set completion signal has been output or not (Step S5).

If the signal is not output (No in Step S5), the control unit 81 repeats this determination.

If the set completion signal is output (Yes in Step S5), the drawing control unit 817 moves the drawing unit 7 to the test-writing portion 61 before the start of the drawing on the nail T and drives the motor 741 of the pen pressing mechanism 74 of the pen carriage 72 holding the pen 71 so that the pen 71 is pressed down by the plate spring 746. This makes the pen 71 ready for the drawing.

The drawing control unit 817 performs the warm-up writing by drawing a predetermined figure such as "○" or "∞" on the drawing medium 61*a* (Step S6).

The warm-up writing may be performed for only the pen 71 necessary to draw the selected nail design or for all the pens 71.

Next, the drawing control unit 817 performs the test-writing by drawing a predetermined figure such as "+" in a blank area on the drawing medium 61*a* in the test-writing portion 61 (Step S7).

The test-writing is performed for all the pen cylindrical members 761 (in this embodiment, eight members) while the pen carriage 72 is rotated by a predetermined amount.

After the test-writing is completed, the camera 501 of the photographing unit 500 is moved above the test-written area, and the test target containing the test-written figures (i.e., figure "+") is photographed by the photographing unit 500 and thus the test target image is acquired (Step S8).

The acquired test target image is sent to the drawing tool identification unit 813.

The drawing tool identification unit 813 is to analyze the image in the area in the test target image where the design is to be drawn with the pen 71 loaded in each pen cylindrical member 761 (Step S9).

If this area does not contain any drawn figure, the drawing tool identification unit 813 determines that the pen cylindrical member 761 does not have a pen or that the member 761 has the pen but the pen runs out of the ink, for example, so that the drawing is not possible.

If the area contains the figure such as "+", the drawing tool identification unit 813 identifies the color of the figure "+", the type of pen 71, and the like from the image.

Then, the type of pen 71 known from the identification results is associated with the position of the pen cylindrical member 761 and stored (Step S10).

The drawing tool identification unit 813 determines whether the pen 71 necessary to draw the selected particular design on the nail T is loaded in the pen carriage 72 (Step S11).

If the drawing tool identification unit 813 has determined that the pen 71 necessary to draw the particular nail design is not loaded (No in Step S11), the display control unit 816 controls the display unit 26 to display the absence of the pen on the notification screen, and requests the user to decide whether to continue the drawing process or not (Step S12).

This notification screen may display, for example, the image in the case of using the current pen 71 or other candidates of the nail design that can be drawn with the pen 71 currently loaded in the pen carriage 72, and ask the user to decide whether to continue the drawing process or not with the current pen 71.

Next, if the user has decided to continue the drawing with the current pen 71, the user inputs the instruction of continuing the drawing process from the operation unit 25 or the like. Here, the nail design to be drawn on the nail T may be changed from the particular nail design selected in Step S3 to any of the displayed candidates of the nail designs that can be drawn by the pens 71 currently loaded in the pen carriage 72.

If, on the other hand, the user has decided not to continue the drawing with the current pen 71, the user instructs to stop the drawing process through the operation unit 25.

Next, the control unit 81 determines whether the instruction to continue the drawing process has been input or the instruction to stop the drawing process has been input (Step S13).

If the instruction to stop the drawing process has been input (No in Step S13), the control unit 81 cancels the drawing process. In this case, the user removes the pen 71 out of the pen carriage 72 and sets the pen 71 necessary to draw the particular picture selected to be drawn on the nail T or the user additionally sets the pen 71 necessary for the particular picture. After that, the user operates the drawing start switch again. This starts the drawing process again from Step S1.

On the other hand, if it has been determined that the pen 71 necessary for the selected particular picture (nail design) is already loaded on the pen carriage 72 (Yes in Step S11) or the user has instructed to continue the drawing process with the current pen 71 (Yes in Step S13), the drawing position correction unit 814 determines whether the position of the figure such as "+" is displaced from the normal drawing position where the figure should originally be drawn (Step S14).

If it has been determined that the figure is displaced from the original drawing position (Yes in Step S14), the drawing position correction unit 814 calculates the correction value for correcting the drawing position to the normal drawing position (Step S15).

The calculated correction value is stored while being associated with each pen 71 (position of the pen cylindrical member 761 having the pen 71 loaded therein) (Step S16).

Next, the user inserts the print finger U1 into the finger acceptance unit 31, and inserts the non-print fingers U2 into the finger retraction unit 32, and operates the finger fixing completion switch with the print finger U1 fixed.

For example, if the user inserts the third finger of the left hand as the print finger U1 into the finger acceptance unit 31, the user inserts the other fingers as the non-print fingers U2 into the finger retraction unit 32.

When the finger fixing completion switch is operated and the signal representing that the print finger U1 has been set is input (Step S17), the photographing control unit 811 controls the photographing unit 500 to photograph the print finger U1 with the camera 501 while illuminating the print finger U1 with the illumination lights 502 before the drawing operation.

Thus, the photographing control unit 811 acquires at least two finger images of the print finger U1 inserted into the finger acceptance unit 31 (Step S18).

Next, the nail information detection unit 812 detects the nail information such as the outline (nail shape) of the nail T, and the distribution of the height and the inclination angle (nail curvature) of the nail T within the outline of the nail T on the basis of the finger image (Step S19).

Upon the detection of the outline (nail shape) of the nail T or the inclination angle (nail curvature) of the nail T by the nail information detection unit 812, the drawing data generation unit 815 adjusts the image data of the nail design in accordance with the nail T (Step S20).

The drawing data generation unit 815 corrects the image data (Step S21).

Specifically, the drawing data generation unit 815 corrects the curved surface in the image data of the nail design on the basis of the nail information.

In addition, if the drawing position correction unit 814 has calculated the correction value, the drawing data generation unit 815 applies this correction value to the drawing data. Thus, the drawing data are generated.

Upon the generation of the drawing data, the drawing control unit 817 outputs the control signal to the drawing unit 7. Thus, the drawing head 70 draws on the nail T on the basis of the drawing data (Step S22).

Specifically, first, the drawing control unit 817 understands the rotation amount of the pen carriage 72 from the results of reading the reference indication 728 with the indication reader 734, and in accordance with the rotation amount of the pen carriage 72, the drawing control unit 817 controls the driving of the motor 731. The pen carriage 72 is rotated until the pen 71 necessary for the drawing comes to the position where the pen pressing mechanism 74 is provided.

Further, the drawing head 70 is moved as appropriate in the X-Y direction to come to the drawing position.

Based on the distribution of the height of the nail T within the outline of the nail T in the nail information, the drawing control unit 817 recognizes the height of the contact position where the pen nib 713 is in contact with the nail T, and drives the motor 741 with the number of steps in accordance with the height.

This operates the pen pressing mechanism 74 to cause the plate spring 746 to press down the column 725.

The pen 71 is then pressed down so that the pen nib 713 of the pen 71 is pressed against the surface of the nail T.

On this occasion, the pen nib 713 is energized in the downward direction by the plate spring 746 with the appropriate pressing force, and moves up and down following the surface shape of the nail T to draw on the surface of the nail T.

In the case where the design is drawn on the plural finger nails T, the process is as follows: the design is drawn on one finger nail T; the nail T with the design drawn thereon is removed from the finger acceptance unit 31; the finger of the nail T where the design is drawn next is inserted as the print finger U1 into the finger acceptance unit 31; and then the finger image of the nail T is acquired and then the above process is repeated.

When the pen 71 is exchanged, the drawing control unit 817 moves the drawing head 70 to the position corresponding to the pen exchange lid portion 23.

The user opens the pen exchange lid portion 23 in this state; then, the user can remove the pen 71 and set another pen.

In this embodiment, the type of pen 71 loaded in the pen carriage 72 is identified by analyzing the test target image obtained by photographing the test target drawn in the test-writing portion 61 with the camera 501. Therefore, the pen 71 can be automatically identified on the apparatus side without the necessity of the user's managing of the type of pen 71.

The type of pen 71 can be identified by photographing the test-written figure "+" (test image) and analyzing the obtained image. This eliminates the necessity of additionally providing a sensor or the like to identify the type of pen 71, thereby simplifying the apparatus structure and reducing the apparatus cost.

Attaching the identification barcode or the like on the pen 71 is not necessary either. Thus, the fabrication cost for the pen 71 can be reduced.

If the pen 71 loaded in the pen carriage 72 is not suitable for drawing the selected particular nail design, this fact is notified by being displayed on the display unit 26, for example. This can make the user know that, before the drawing, the desired picture cannot be drawn with the current pen 71. Thus, it is possible to prevent the user from mistakenly load the pen 71 different from the pen necessary to draw the selected particular nail design and to avoid the drawing failure.

Moreover, if the display unit 26 displays the image in the case where the drawing is carried out with the current pen 71, the user can select whether the drawing is carried out after exchanging the pen 71 to the pen 71 necessary to draw the particular nail design or the drawing is carried out with the current pen 71 by changing some colors to be different from the original colors in the particular nail design.

If the drawing is carried out with the current pen 71, there may be some color variations. If these variations are displayed, the user can choose the design close to the desired one.

Moreover, if the nail design candidate that can be drawn with the current pen 71 will be displayed in the display unit 26, the apparatus can suggest the design which is not the particular nail design selected initially by the user but is more appropriate for the current pen 71.

Since there are a wide variety of types of pens 71, it is difficult for the user to have all types of pens 71. In this regard, the apparatus suggests the nail designs that can be drawn with the pens 71 currently loaded in the apparatus; therefore, the user does not need to buy an extra pen 71 and still can enjoy the nail printing by selecting the nail design as preferable as possible.

In addition, in this embodiment, it is determined whether the drawing position of the pen 71 is displaced from the normal drawing position on the basis of the test target image obtained by photographing the test target drawn in the test-writing portion 61. If it has been determined that the drawing position is displaced, the correction value for correcting the displacement is calculated. Thus, it is not necessary to have another member or mechanism mounted for determining the displacement. If there is the displacement, the correction is performed based on the calculated correction value and thus the drawing can be carried out at the appropriate position. Thus, it is possible to achieve the highly precise drawing with the displacement suppressed by a simple and inexpensive method without providing the mechanical structure for preventing the displacement on the apparatus side. In this case, the pen 71 does not need to have high accuracy and therefore the increase in cost of the pen 71 can be suppressed.

The embodiment to which the present invention is applicable is not limited to the above embodiment and various changes can be made within the scope of the present invention.

For example, in the above embodiment, the pen 71 is pressed down by operating the plate spring 746 with the pen lifting motor 741; however, the structure of moving up and down the pen 71 is not limited thereto.

Figure 7:
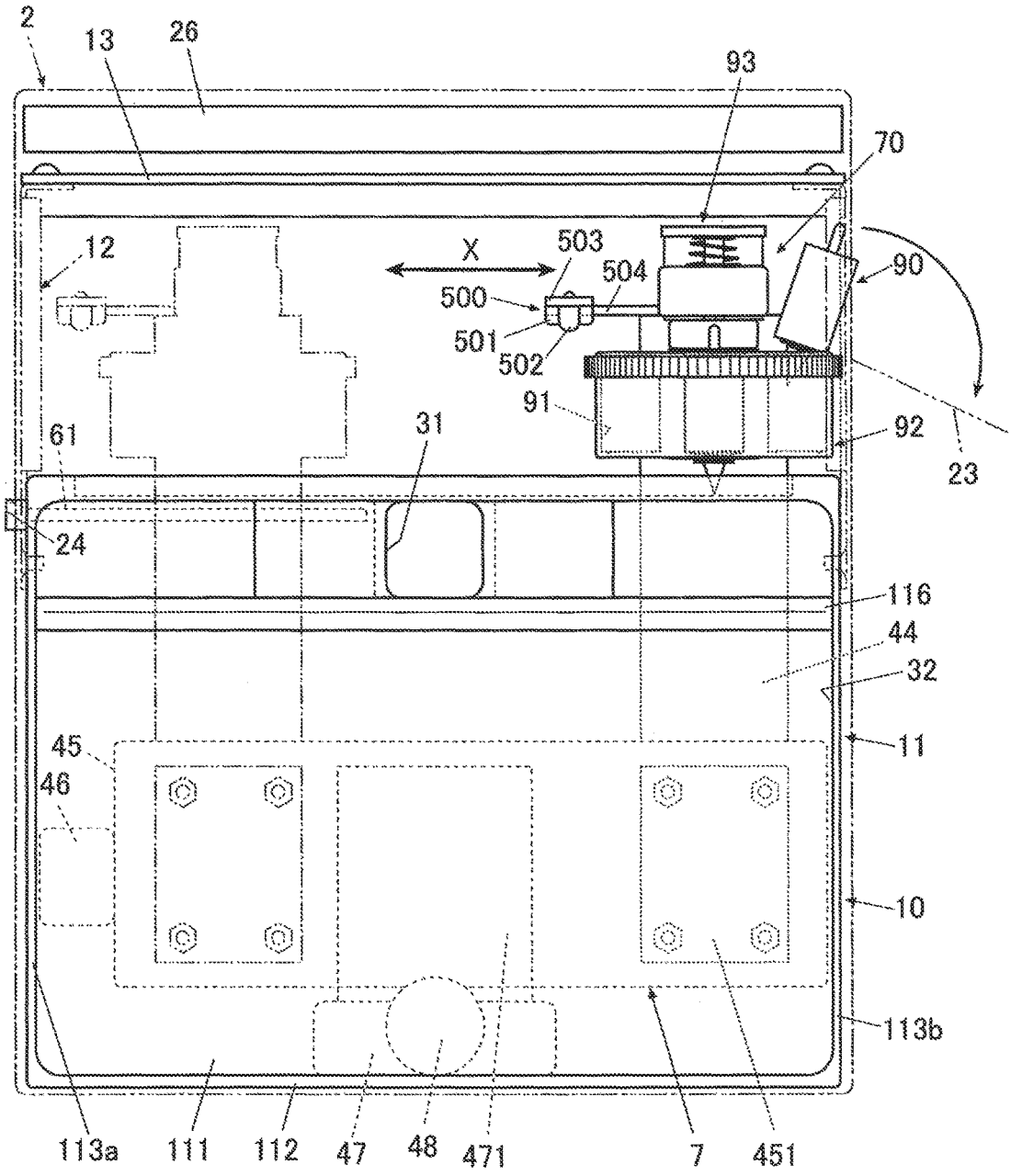
FIG. 7 is a front view of a modified example of the nail printing apparatus.

For example, as illustrated in FIG. 7, a solenoid 93 that can press down a pen 90 may be provided on a pen carriage 92 having a pen holder 91 for housing a pen 90. With the solenoid 93, the pen 90 can be pressed down and the pen 90 can be moved up and down with the spring force of a spring, which is not shown, provided in the pen 90, for example.

In this embodiment, the pen 71 is loaded in the rotatable pen carriage 72 including the plurality of pen cylindrical members 761; however, the structure of the pen carriage of the drawing head 70 is not limited thereto.

Figure 8:
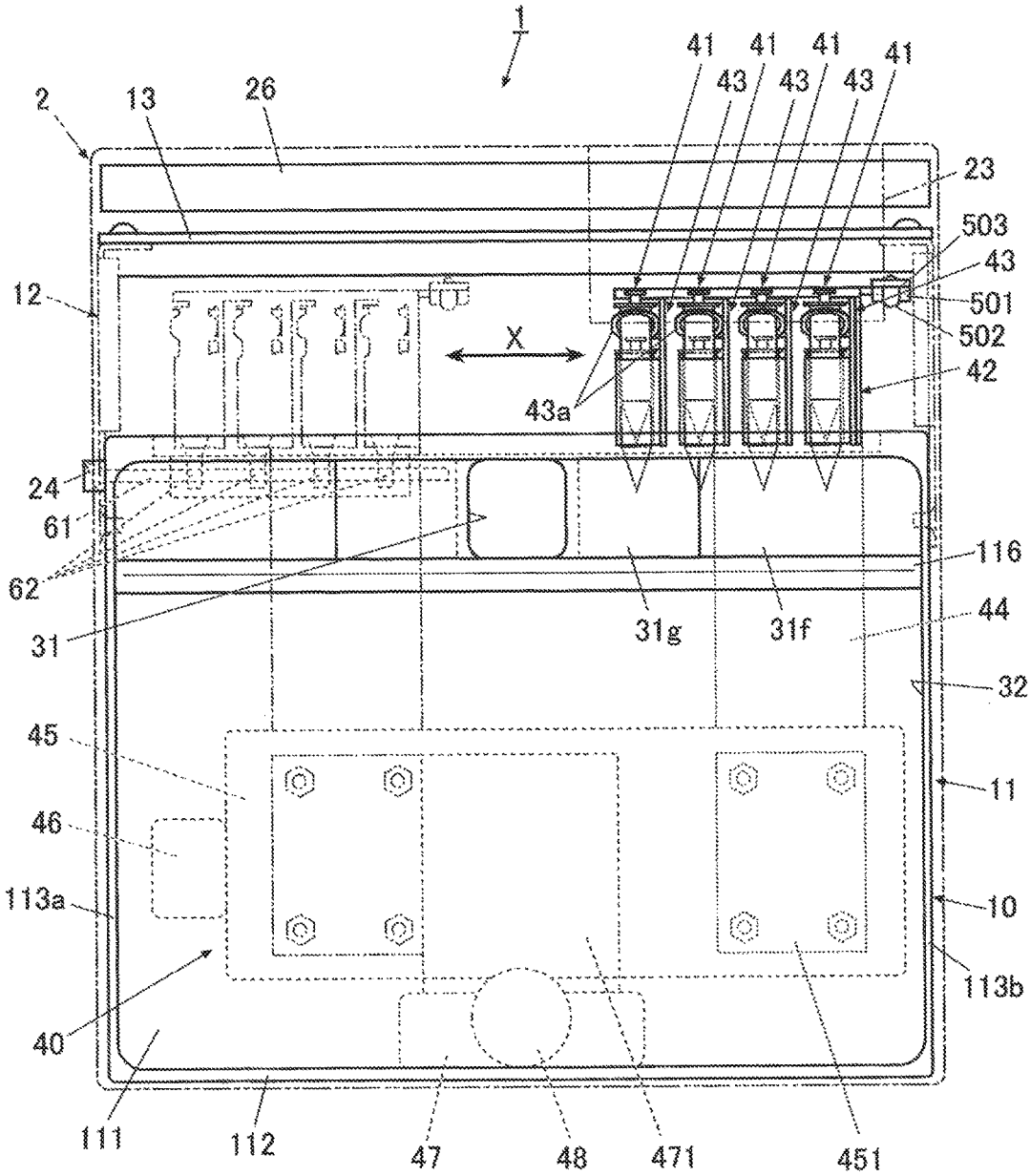
FIG. 8 is a front view of a modified example of the nail printing apparatus.

For example, as illustrated in FIG. 8, a drawing head 42 may have a plurality of pen carriages 43 each holding a pen 41.

In such a structure, for example, the pen 41 is moved up and down by operating a lever 43*a* that locks the pen 41 with a solenoid or the like, which is not shown. In this case, the pen carriage 43 and the pen 41 can have the simple structure.

In FIG. 8, four pen carriages 43 are disposed in the width direction of the apparatus (left-right direction, X-direction in FIG. 8). However, the number of pen carriages 43 provided for the drawing head 42 is not limited to the particular number.

For example, the drawing head 42 may have one pen carriage 43 holding one pen 41. In this case, the user exchanges the pen 41 manually as necessary. This can achieve the nail printing apparatus 1 with the pen 41 at low cost.

Alternatively, the drawing head 42 may have one pen carriage 43, and the pen 41 loaded in the pen carriage 43 may be automatically exchanged. In this case, for example, the plural pens 41 are placed in a standby space, and the apparatus automatically selects one pen 41 and sets the selected pen 41 to the drawing head. In this structure, more pens 41 can be held in the apparatus.

Moreover, in this embodiment, the photographing unit 500 including the camera 501 and the illumination lights 502 is fixed beside the drawing head 70, and the photographing unit 500 and the drawing head 70 move together. However, the photographing unit is not limited to be fixed to the drawing head 70.

For example, a movement mechanism for moving the photographing unit and a mechanism for moving the drawing head 70 may be separated.

Figure 9:
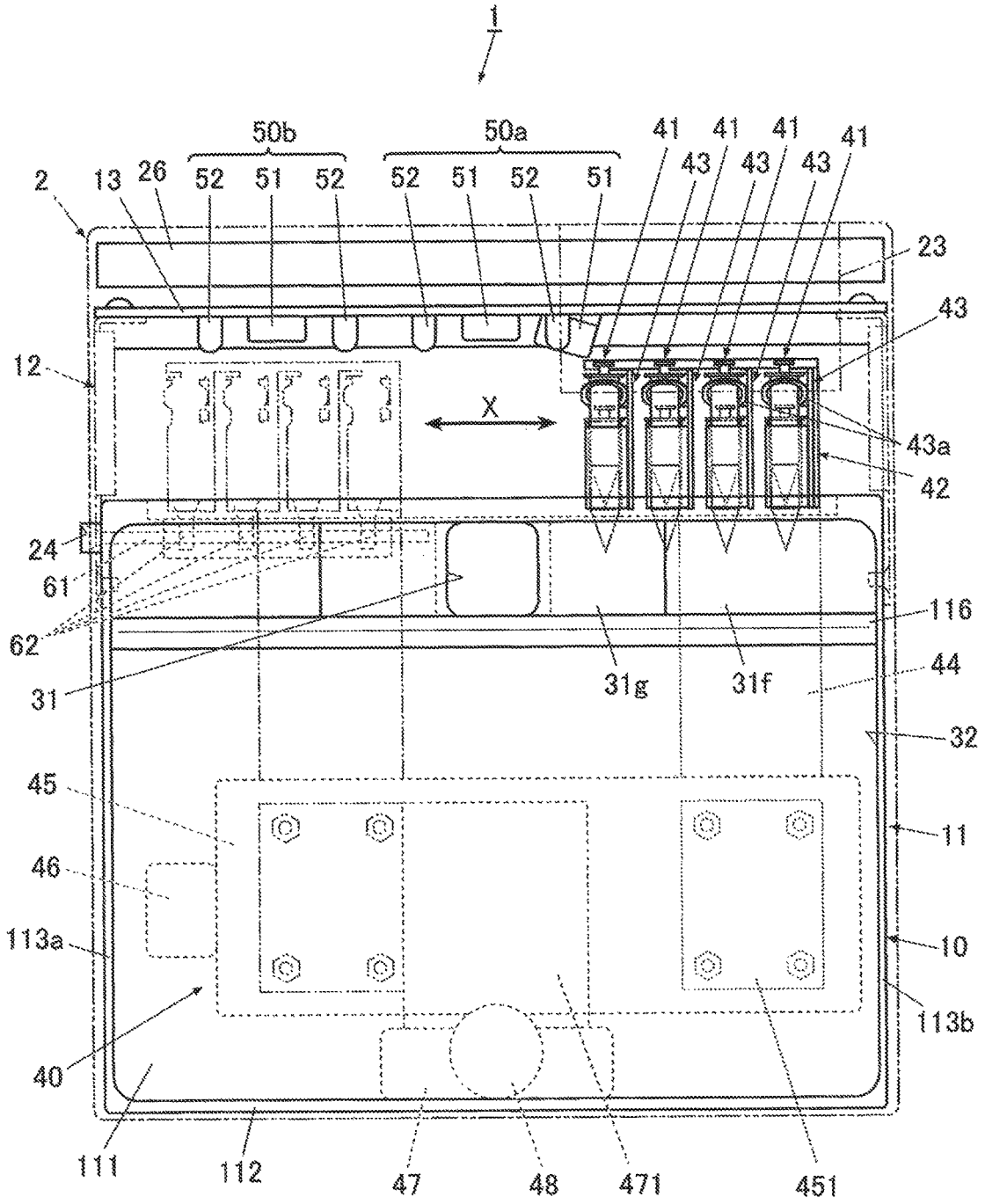
FIG. 9 is a front view of a modified example of the nail printing apparatus.

For example, as illustrated in FIG. 9, a photographing unit including a camera 51 and illumination lights 52 may be fixed above the nail printing apparatus.

In this case, in addition to a photographing unit 50*a* placed above the finger acceptance unit 31 to photograph the nail T (print finger U1), a photographing unit 50*b* including the camera 51 and the illumination lights 52 for acquiring the test target image is disposed above the test-writing portion 61.

In the case of having the photographing units fixed in this manner, the photographing unit 50*a* that photographs the nail T (print finger U1) preferably has two cameras 51 at different positions so that the nail T can be photographed from different angles.

In this embodiment, the present invention is applied to the nail printing apparatus 1 including the plotter type drawing head 70 having the pen 71. However, the nail printing apparatus to which the present invention is applicable is not limited to the plotter type.

For example, the present invention is applicable to a hybrid type nail printing apparatus including the ink jet type and the plotter type.

Figure 10A:
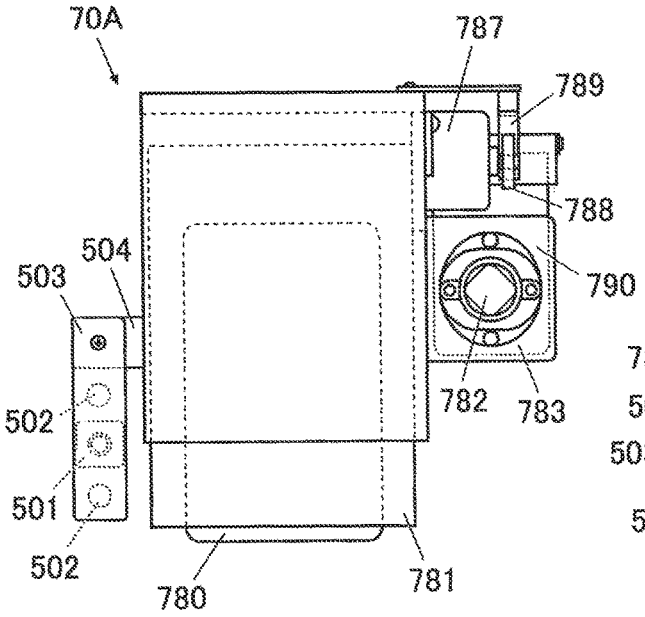
FIG. 10A and FIG. 10B are explanatory views illustrating a modified example of the drawing head.
Figure 10B:
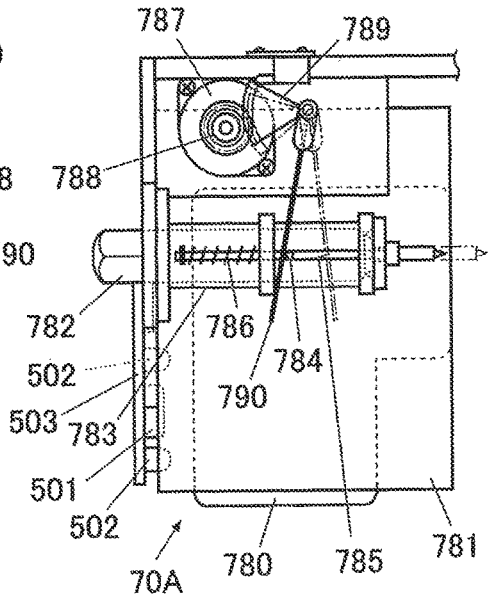

FIGS. 10A and 10B are explanatory views illustrating a modified example of the drawing head, and FIG. 10A is a top view and FIG. 10B is a side view.

As illustrated in FIGS. 10A and 10B, a drawing head 70A includes an ink holder 781 holding an ink cartridge 780, and a pen holder 783 holding a pen 782. The drawing head 70A and the pen holder 783 are adjacent to each other.

The pen holder 783 includes an assistant member 785 that is fixed to the pen 782 with a screw or the like and moves up and down with the pen 782. The assistant member 785 includes a projection 784 that protrudes in a direction apart from the axis center of the pen 782. The pen holder 783 has a coil spring 786 that energizes the assistant member 785 in the upward direction.

The pen lifting mechanism is configured so that the pen 782 is pressed down when the projection 784 of the assistant member 785 is directly pressed down by a plate spring 790 that is hooked by the projection 784.

With the structure, the pen 782 can be exchanged easily and the height of the pen lifting mechanism can be suppressed to be relatively low.

Here, near the pen holder 783 are provided a motor 787 including a stepping motor, a gear 789 that engages with a gear 788 attached to the rotation shaft of the motor 787, and the plate spring 790 that rotates following the rotation of the gear 789.

The plate spring 790 is hooked by the projection 784 so that the plate spring 790 can press down the pen 782.

Rotating the plate spring 790 following the rotation of the motor 787 causes the plate spring 790 to be hooked by the projection 784 and press down the projection 784. The pressed projection 784 causes the pen 782 to go down against the energizing force of the coil spring 786.

In this structure, the present invention can similarly be applied in the determination as to whether the pen 782 as the drawing tool necessary to draw the selected particular design is loaded or not, the determination as to whether the drawing position of the pen 782 is displaced from the normal drawing position, and the calculation of the correction value if there is the displacement in the drawing position.

In this embodiment, the warm-up writing and the test-writing are separately carried out. However, the figure drawn in the warm-up writing may be photographed and be used to identify the type of the drawing tool, determine the drawing position, or calculate the correction value.

In this case, the figure "+" or the like is drawn in the warm-up writing. By drawing a line with a certain degree of length, the figure to be tested can be drawn though the beginning part of the line may blur a little. In this case, the test-writing and the warm-up writing can be completed with one drawing, so that the time can be saved and the amount of consumption of ink can be minimized.

In this embodiment, the type of pen 71 as the drawing tool is identified, the drawing position is determined, and the correction value is calculated based on the test target image obtained by photographing the figure drawn in the test-writing. However, the type of pen 71 as the drawing tool may be identified, the drawing position may be determined, and the correction value may be calculated based on different images. In this case, the figure that is more suitable for each process is drawn so that more accurate identification or determination becomes possible.

In this embodiment, the type of pen 71 as the drawing tool is identified, the drawing position is determined, and the correction value is calculated. In the present invention, however, all of them are not necessarily performed. Any one of them may be performed.

In this embodiment, in order to obtain the test target image for identifying the type of pen 71, determining the drawing position, and calculating the correction value, the test-writing is performed by drawing figures such as "+" sequentially for all the pen cylindrical members 761 regardless of whether the pen 71 is loaded in the member 761 or not. However, the target subjected to the test-writing is not limited to that shown in this embodiment.

For example, if it has been known which pen cylindrical member 761 holds the pen 71, the test-writing may be performed for only the pen cylindrical member 761 holding the pen 71.

In this case, the test-writing can be performed for only the member 761 holding the pen 71 efficiently, so that the time taken to acquire the test target image can be shortened.

The number of test targets (i.e., figure "+") included in the test target image is the number of pens 71 loaded in the pen carriage 72; therefore, the process time of the drawing tool identification unit 813 or the drawing position correction unit 814 can also be reduced.

In this structure, which pen cylindrical member 761 holds the pen 71 can be determined as follows: for example, the reference indication 728 is read when the pen 71 is set, and how many pens 71 are set is counted by the apparatus and the pen cylindrical members 761 for which the pen 71 is set are specified.

In this embodiment, the stepping motor with the gear head is described as the motor 741 that rotates the plate spring 746. However, if the gear is additionally provided, the stepping motor without the gear head can be used.

Alternatively, the stepping motor capable of the half-step driving or the motor with the small step angle can be used.

Further alternatively, a servomotor or a DC motor can be used instead of the stepping motor. In this case, the rotary encoder for detecting the motor rotation angle is preferably used.

In the embodiment, the X-direction movement stage 45 and the Y-direction movement stage 47 for moving the drawing head 70 are formed by combining the X-direction movement motor 46 and the Y-direction movement motor 48, which are the stepping motor, and ball screws and guides which are not shown. The structure for moving the drawing head 70 is, however, not limited thereto.

The X-direction movement motor 46 and the Y-direction movement motor 48 only need to move the drawing head 70 in the front-back and left-right directions and for example, may employ a structure formed of a shaft, a guide, and a wire, which has conventionally been employed by conventional inexpensive printers or the like, or a structure formed of a servomotor or the like.

In this embodiment, the drawing medium in the test-writing and the warm-up writing for the pen 71 as the drawing tool is a sheet of paper but is not limited to the paper. The drawing medium may be any medium as long as the drawing with the pen 71 is possible.

The drawing medium may be a rolled medium. In this case, a medium feeding mechanism is provided which can feed and wind up the drawing medium automatically or manually. If the drawing medium is the rolled medium, a medium attachment/detachment port where the rolled drawing medium is attached or detached is provided instead of the medium insertion/extraction port 24.

In the embodiment, the drawing data generation unit 815 corrects the curved surface of the image data of the nail design and generates the drawing data. However, the generation of the drawing data by the drawing data generation unit 815 is not an essential element in the present invention.

For example, the drawing data are not generated separately and the drawing control unit 817 may control the drawing so that the drawing in accordance with the nail shape is carried out by converting the image data of the nail design with the LUT (Lookup Table) or the like and outputting the data to the drawing head.

In the above embodiment, the shape of the nail T is detected as the nail information, based on which the drawing data are generated. However, detecting the nail shape is not an essential element of the present invention.

If extracting the outline of the nail T is not essential in the drawing, for example if the very small design is drawn in the middle of the nail T, it is not necessary to recognize the shape of the nail T accurately and in this case, the detection of the nail shape is not necessary in the drawing.

The camera 501 in the photographing unit is not limited to the camera 501 that photographs the still image and may be the camera that can photograph a motion image. In this case, the motion image is photographed by the camera and the image of the upper surface of the nail T is cut out from the photographed motion image and used in the detection of the nail information.

In the embodiment, the nail image storage region 821, the nail information storage region 822, and the nail design storage region 823 are provided in the storage unit 82 of the control device 80. However, the nail image storage region 821, the nail information storage region 822, and the nail design storage region 823 are not necessarily provided in the storage unit 82 of the control device 80, and the storage unit may be provided separately.

In the embodiment, the finger is inserted into the nail printing apparatus 1 one by one, and the design is drawn on the nail of the inserted one finger in the nail printing apparatus 1. However, the present invention is applicable to the apparatus which can successively print the design on the nails of a plurality of fingers inserted into the apparatus at the same time.

For example, the design can be successively drawn on the nails of a plurality of print fingers U1 by enlarging the operation range of the pen 71 to increase the drawing possible range.

The embodiment of the present invention have been described so far; however, the scope of the present invention is not limited to the above embodiment and includes the scope of the present invention according to the scope of claims and its equivalent range.

What is claimed is:

1. A drawing apparatus comprising:

a drawing head in which at least one drawing tool is loaded, the drawing tool drawing on a drawing target and a drawing medium different from the drawing target;

a test-writing device on which the drawing medium is placed; and a control device configured to identify a type of the drawing tool loaded in the drawing head on the basis of a test target image acquired from an area on the drawing medium drawn with the drawing tool in the test-writing device, wherein:

the drawing tool is a pen having a tip part which applies ink to the drawing target and the drawing medium to draw on the drawing target and the drawing medium, and the type of drawing tool corresponds to at least one of a kind of ink and a thickness of the tip part.

2. The drawing apparatus according to claim 1, wherein the control device determines whether at least one particular kind of the drawing tool, which is necessary to draw a particular nail design selected by a user on the drawing target, is loaded in the drawing head on the basis of a result of the identifying.

3. The drawing apparatus according to claim 2, further comprising a display device, wherein the control device performs a control which causes the display device to display image information representing that the particular drawing tool is not loaded in the drawing head to notify the user in a case in which it is determined that the particular drawing tool is not loaded in the drawing head.

4. The drawing apparatus according to claim 2, wherein in a case in which it is determined that the particular drawing tool is not loaded in the drawing head, the control device executes at least one of the following:

(i) causing a display device to display an image showing how the particular nail design would look in a case where the drawing tool loaded in the drawing head is used to draw the particular nail design; and (ii) causing the display device to display one or more candidates of a nail design, which is different from the particular nail design and which can be drawn with the drawing tool loaded in the drawing head.

5. The drawing apparatus according to claim 1, wherein the control device is configured to determine whether a drawing position of the drawing tool on the drawing medium is displaced from a preset normal drawing position on the basis of the test target image, and in a case in which it has been determined that the drawing position is displaced from the normal drawing position, calculate a correction value for correcting the drawing position to the normal drawing position.

6. The drawing apparatus according to claim 5, wherein the control device performs:

controlling the drawing head to control drawing on the drawing medium with the drawing tool and drawing of a particular nail design on the drawing target; and generating drawing data for drawing the particular nail design on the drawing target with the drawing tool on the basis of image data of the particular nail design, wherein:

in the generating of the drawing data, the correction value is applied to the drawing data, and the controlling of the drawing head is performed on the basis of the drawing data after the correction value is applied, when the particular nail design is drawn on the drawing target with the drawing tool.

7. The drawing apparatus according to claim 1, wherein: the drawing target is a finger nail of a hand or a foot; and the drawing medium is a sheet of paper.

8. A drawing apparatus comprising:

a drawing head in which at least one drawing tool, which draws on a drawing target and a drawing medium different from the drawing target, is loaded;

a test-writing device on which the drawing medium is placed; and a control device, wherein the control device is configured to determine whether at least one particular kind of the drawing tool, which is necessary to draw a particular nail design selected by a user on the drawing target, is loaded in the drawing head, and to determine whether a drawing position of the drawing tool is displaced from a preset normal drawing position on the basis of a test target image acquired from an area of the drawing medium drawn with the drawing tool in the test-writing device, and in a case in which it has been determined that the drawing position is displaced from the normal drawing position, calculate a correction value for correcting the drawing position to the normal drawing position.

9. The drawing apparatus according to claim 8, wherein the control device performs:

controlling the drawing head to control drawing on the drawing medium with the drawing tool and drawing of the particular nail design on the drawing target; and generating drawing data for drawing the particular nail design on the drawing target with the drawing tool on the basis of image data of the particular nail design, wherein:

in the generating of the drawing data, the correction value is applied to the drawing data, and the controlling of the drawing head is performed on the basis of the drawing data after the correction value is applied, when the particular nail design is drawn on the drawing target with the drawing tool.

10. A drawing apparatus comprising:

a drawing head in which at least one drawing tool is loaded, the drawing tool drawing on a drawing target and a drawing medium different from the drawing target;

a test-writing device on which the drawing medium is placed; and a control device configured to identify a type of the drawing tool loaded in the drawing head on the basis of a test target image acquired from an area on the drawing medium drawn with the drawing tool in the test-writing device, and to determine whether at least one particular kind of the drawing tool, which is necessary to draw a particular nail design selected by a user on the drawing target, is loaded in the drawing head on the basis of a result of the identifying.

11. The drawing apparatus according to claim 10, further comprising a display device, wherein the control device performs a control which causes the display device to display image information representing that the particular drawing tool is not loaded in the drawing head to notify the user in a case in which it is determined that the particular drawing tool is not loaded in the drawing head.

12. The drawing apparatus according to claim 10, wherein in a case in which it is determined that the particular drawing tool is not loaded in the drawing head, the control device executes at least one of the following:

(i) causing a display device to display an image showing how the particular nail design would look in a case in which the drawing tool loaded in the drawing head is used to draw the particular nail design; and (ii) causing the display device to display one or more candidates of a nail design, which is different from the particular nail design and which can be drawn with the drawing tool loaded in the drawing head.

13. A drawing apparatus comprising:

a drawing head in which at least one drawing tool is loaded, the drawing tool drawing on a drawing target and a drawing medium different from the drawing target;

a test-writing device on which the drawing medium is placed; and a control device configured to determine whether a drawing position of the drawing tool on the drawing medium is displaced from a preset normal drawing position on the basis of a test target image acquired from an area on the drawing medium drawn with the drawing tool in the test-writing device, and in a case in which it has been determined that the drawing position is displaced from the normal drawing position, calculate a correction value for correcting the drawing position to the normal drawing position.

14. The drawing apparatus according to claim 13, wherein the control device performs:

controlling the drawing head to control drawing on the drawing medium with the drawing tool and drawing of a particular nail design on the drawing target; and generating drawing data for drawing the particular nail design on the drawing target with the drawing tool on the basis of image data of the particular nail design, wherein:

in the generating of the drawing data, the correction value is applied to the drawing data, and the controlling of the drawing head is performed on the basis of the drawing data after the correction value is applied, when the particular nail design is drawn on the drawing target with the drawing tool.

15. A drawing apparatus comprising:

a drawing head in which at least one drawing tool is loaded, the drawing tool drawing on a drawing target and a drawing medium different from the drawing target;

a test-writing device on which the drawing medium is placed; and a control device configured to identify a type of the drawing tool loaded in the drawing head on the basis of a test target image acquired from an area on the drawing medium drawn with the drawing tool in the test-writing device, wherein:

the drawing target is a finger nail of a hand or a foot; and the drawing medium is a sheet of paper.

* * * * *